US010527376B2

(12) United States Patent
Slevin et al.

(10) Patent No.: US 10,527,376 B2
(45) Date of Patent: Jan. 7, 2020

(54) ELECTRONIC MAGAZINE LOADER

(71) Applicant: Vista Outdoor Operations LLC, Farmington, UT (US)

(72) Inventors: Richard Slevin, Palo Alto, CA (US); Paul R. Fischer, Olathe, KS (US)

(73) Assignee: VISTA OUTDOOR OPERATIONS LLC, Farmington, UT (US)

( * ) Notice: Subject to any disclaimer, the term of this patent is extended or adjusted under 35 U.S.C. 154(b) by 0 days.

(21) Appl. No.: 16/193,873

(22) Filed: Nov. 16, 2018

(65) Prior Publication Data

US 2019/0226780 A1 Jul. 25, 2019

Related U.S. Application Data

(63) Continuation-in-part of application No. 29/634,339, filed on Jan. 19, 2018.

(60) Provisional application No. 62/620,381, filed on Jan. 22, 2018.

(51) Int. Cl.
*F41A 9/83* (2006.01)

(52) U.S. Cl.
CPC ..... *F41A 9/83* (2013.01)

(58) Field of Classification Search
CPC ..... F41A 9/01; F41A 9/82; F41A 9/83; F41A 9/84; B65G 47/18; B65G 47/19; B65G 47/20
USPC ..... 42/87; 89/33.5; 86/23, 45, 47
See application file for complete search history.

(56) References Cited

U.S. PATENT DOCUMENTS

| | | | | | |
|---|---|---|---|---|---|
| 4,881,447 | A * | 11/1989 | Yanusko | F41A 9/82 | 89/34 |
| 4,939,862 | A * | 7/1990 | Brandenburg | F41A 9/83 | 42/87 |
| 4,949,495 | A * | 8/1990 | Mari | F41A 9/83 | 42/87 |
| 4,970,820 | A * | 11/1990 | Miller | F41A 9/83 | 42/87 |
| 2014/0373421 | A1* | 12/2014 | Hatch | F41A 9/83 | 42/87 |
| 2016/0202007 | A1* | 7/2016 | Hatch | F41A 9/67 | 42/87 |
| 2016/0305726 | A1* | 10/2016 | Mokuolu | F41A 9/83 | |

* cited by examiner

*Primary Examiner* — Bret Hayes
(74) *Attorney, Agent, or Firm* — Walter M. Egbert, III; Gerard M. Donovan; Reed Smith LLP

(57) ABSTRACT

A motorized magazine loader for loading cartridges into a magazine includes a powered sorting and lifting wheel rotatable about a horizontal axis of rotation, a vertical gravity fed cartridge chute positioned laterally next to the sorting and lifting wheel, an accumulator portion at a lower end of the chute, and a loading portion comprising a receiver for magazines to be loaded and a pusher mechanism for inserting cartridges into the magazines, all supported and substantially contained by a housing. Control circuitry mediates jamming of cartridges within the loader.

20 Claims, 19 Drawing Sheets

ELECTRONIC MAGAZINE LOADER

CROSS-REFERENCE TO RELATED APPLICATION

This application is a continuation-in-part of U.S. application Ser. No. 29/634,339, filed Jan. 19, 2018, and also claims the benefit of U.S. Provisional Application No. 62/620,381, filed Jan. 22, 2018, the disclosure of both are incorporated by reference herein.

BACKGROUND OF THE DISCLOSURE

In order to maintain their proficiency with firearms, military personnel, law enforcement officers and hunters frequently engage in target practice. Target practice is often performed at a shooting range with hundreds cartridges being fired at each practice session. In the sport of hunting, marksmanship is practiced so that a shot can be carefully placed to ensure a quick, clean and humane kill. For military personnel, good marksmanship may make the difference between victory and defeat in battlefield situations.

Many firearms, including pistols and rifles, are designed to utilize a removable magazine that holds ammunition cartridges. The use of a magazine allows a plurality of stacked cartridges to be easily loaded into the firearm by inserting a single magazine into the firearm. After each cartridge is fired, a manually or automatically operated mechanism moves the bolt of the firearm backward and then forward again. The upper-most cartridge is pulled off the stack of cartridges in the magazine each time the mechanism cycles so that cartridges are fed one-by-one into the firing chamber of the firearm. Each magazine typically has an elongate housing defining a chamber with a spring loaded follower slidably disposed therein. The force of the spring loaded follower urges each cartridge in the magazine toward the upper-most position in the where the bolt can push it into the firing chamber. When all of the cartridges have been fired, the empty magazine is removed from the firearm and a new magazine is inserted in its place. The empty magazine may then be refilled with cartridges. Loading such cartridges manually has been tedious and time consuming. Although devices have been provided to assist in such manual loading, improvements and automating the loading functions in an economical device would be well received.

SUMMARY

Known electronic magazine loaders typically have exposed operating equipment and leave room for improvement of efficient containment of the operating mechanisms within a compact housing, as well as improvement in such operating mechanisms, as well as improvements in operational ergonomics. The following U.S. patents and publication disclose electronic magazine loaders: U.S. Pat. Nos. 4,949,495; 9,612,070; 9,719,741; and 2016/0305727. These references are incorporated by reference for all purposes.

A motorized magazine loader for loading cartridges into a magazine includes a powered sorting and lifting wheel rotatable about a horizontal axis of rotation, a vertical gravity fed cartridge chute positioned laterally next to the sorting and lifting wheel, an accumulator portion at a lower end of the chute, and a loading portion comprising a receiver for magazines to be loaded and a pusher mechanism for inserting cartridges into the magazines, all supported and substantially contained by a housing. Optimal and ergonomic arrangement of the components and housing configuration provides a minimal footprint, a reduced volumetric size, easy user access to controls, easy access for loading of cartridges, easy insertion and removal of magazines, high stability, and easy transportability. Control circuitry includes jam mediation means.

In embodiments, the housing contains and supports the powered rotatable wheel, the wheel having an open interior and circumferentially spaced singularizing lifting shelves at its periphery. The housing having an access door for placement of unordered cartridges in a receiving region that includes the open interior to be loaded. The receiving region may be defined by wall portions of the housing and a hub plate of the wheel that support the lifting shelves. The wheel at its periphery having an open window facing radially outward at each shelf. The wheel rotatable within a cylindrical wall portion fixed with respect to the housing or chassis such that each shelf and the cylindrical wall portion radially exterior of the respective window defines a lifting pocket, the pockets elongate horizontally and parallel or generally parallel to the axis of rotation of the wheel. The pockets receive and lift the cartridges, in embodiments, serially (one by one), after an unordered batch of cartridges is placed inside the interior of the wheel. The individual cartridges being aligned in the pockets parallel to or generally parallel to the axis of rotation, but are not oriented with respect to which of two ways the forward and rearward ends are directed. The individual cartridges are lifted to an elevated horizontal wheel discharge slot in or supported by the housing. In embodiments, the discharge slot is defined by an opening in the cylindrical wall portion. The cartridges are transferred, one by one, through the wheel discharge slot and into a gravity fed passageway defined by the chute.

The chute generally having an opening thickness slightly greater than a maximum diameter of the cartridge. The chute having an upper portion with an opposing restrictive structures narrowing the thickness of the chute on each of two sides of the chute, but not in a middle portion of the upper portion. The restrictive structures sized to allow the forward end of the cartridge, due to the reduced diameter of the forward end, to fall downward but prevents the rearward end of the cartridge to pass through the restrictive structures due to increased diameter of the rearward portion. As the forward end falls the cartridge rotates such that the rearward end is upwardly from the forward end and the rearward end becomes more centered in the upper portion where there is no restrictive structure, allowing the cartridge to fall, forward end, that is the tip end, first. The shape of the chute then narrows and sweeps to a horizontal direction forcing each cartridge to rotate as they travel down the chute to a horizontal orientation where they then drop downwardly into a stack in an accumulator portion. The accumulator has a singular exit slot located below the stack. A series of single cartridges is fed, one by one, through the singular exit slot and into a cartridge receiving region of the pusher mechanism.

The pusher mechanism has a reciprocating pusher with a plunger portion and a magazine receiver positioned opposite each other with respect to the cartridge receiving region. The pusher mechanism comprises a motor a having a drive shaft and a cam member fixed to the drive shaft. The cam member is received in a cam follower cavity defined by the pusher of the pusher mechanism. The cam member is eccentrically shaped so that rotation of the drive shaft causes the pusher to oscillate in a first direction away from the magazine and a second direction toward the magazine as the cam member rotates in the cam follower cavity. As the pusher oscillates, the plunger portion of the pusher mechanism pushes the series of single cartridges, one by one, from the lowermost cartridge receiving region in a horizontal direction transverse to the stack, into a magazine secured in the magazine receiver. The magazine retains the cartridge as the plunger retracts and as the plunger retracts past the stack, the next cartridge in the stack falls to the lowermost cartridge receiving region.

A feature and advantage of embodiments is an external panel provides chute defining structure on an inward facing side of the panel. The chute defined by panel and an outwardly facing wall which may be part of the housing. The external panel readily removable such that a panel with a differently sized chute for a different cartridge size may be installed. The panel may be formed of transparent plastic material to allow viewing of the cartridge path. Such visibility provides instant information as to cartridge jams or overfilling of the accumulator portion and provides an interesting presentation of the operation of the device to observers. Such jams may occur, for example, when incorrectly sized cartridges are mixed with correctly sized cartridges.

A feature and advantage of embodiments is a four sided desk top or table top, magazine ammo loader that has a forward side, facing the user, that includes a user interface, a magazine receiver, and a transparent panel, all on the forward side, that allows visual monitoring of the cartridge pathway during the sorting/alignment process. For example if the cartridge receiving region is empty, it will be evident from the visible lack of cartridges falling down the transparent pathway that is a clear cartridge pathway. A feature and advantage is placement of the significant portion of the cartridge pathway at the forward panel where the pathway is visible from the user's operating position. A further feature and advantage is the accessibility of the removable front panel accessing a significant portion of the cartridge pathway, including all or most of the gravity fed pathway.

A feature and advantage of embodiments is an ergonomic advantageous configuration. An upwardly tapered housing provides stability of the loader in operation and transportation with a retractable handle positioned at the uppermost portion of the magazine loader. In embodiments the footprint and downwardly facing surface area of the base is several multiples greater that the horizontal top panel area. And the horizontal cross sectional area of the housing interior decreasing upwardly to top of the housing. The sorting and lifting wheel is nested in the interior upper portion of the tapering housing with a user interface positioned at a panel adjoining the uppermost panel and angled at an acute angle from horizontal, the housing and panel conforming to the wheel shape, minimizing unused interior volume, minimizing the amount of housing, thereby minimizing the size and weight of the magazine loader. The user interface at the upwardly directed panel provides direct viewing to the user with the panel arranged at substantially 90° to the typical viewing direction of an operator standing or seated when the loader is on a table or bench.

A feature and advantage of embodiments is an arrangement that monitors the current drawn by one or more motors of the loader, for example a drive motor for the sorting and lifting wheel or the motor for the pushing mechanism. If the current drawn by one of the motors is greater than a preselected threshold, such as would be caused by a jam, then the current flow to the motor is cut off or the motor is reversed for a few seconds, for example, three seconds. If the wheel is not able to then rotate normally, the wheel can be reversed again. After a predetermined number of reversals, the system errors out and the motor may be disconnected. The arrangement may prevent damage to the loader, for example, in the event of a misfeed condition.

A feature and advantage of embodiments is circuitry including a sensor for monitoring the rotation of the wheel, for example, by a rotary encoder. When an interruption in the rotation of the wheel is detected, suggesting a jammed condition of the cartridges, the motor driving the wheel can be temporarily reversed to alleviate the jammed condition, for example for three seconds. If the wheel is not able to then rotate normally, the wheel can be reversed again. After a predetermined number of reversals, the system errors out and the motor may be stopped from all rotation. Such jam mediation means may prevent damage to the loader, for example, in the event of a misfeed condition. A feature and advantage is a system is a jam mediation system that automatically attempts to eliminate jams.

A feature and advantage is that the arrangement of the components provides a compact light weight motorized desktop magazine loader suitable for transporting and use such as to the range. The device having a rectangular footprint having a front side with user interface controls and display, with the receiver with the insertion slot for magazines to be loaded, and with the removable chute components, all positioned on the front side. Additionally, the housing including a folding handle, the cartridge loading hopper being retractable, and the magazine receiver projecting outwardly a minimal amount. In embodiments, a cover for the receiving region for the unordered cartridges also operates as a lid for closing of the receiving region during operation of the electronic magazine loader.

In embodiments, a robust assembly of components provides for a compact light weight electronic magazine loader. The housing generally having a base and four side walls with an upward inwardly taper. The housing also providing the chassis for securing the electronic magazine loader componentry therein and may be formed of a housing base, a three-sided housing enclosure portion and a housing side wall portion. The housing components may all readily be injection molded of polymers. The three sided enclosure portion having a wall portion including a circular recess extending inwardly and defined by a cylindrical wall portion and wall plate portion traversing the cylindrical wall portion. The circular recess containing the sorting and lifting wheel with the cylindrical wall portion conforming to the wheel periphery. The wall plate portion traversing the cylindrical wall and providing drive train mounts for rotating the wheel. The wall plate portion may have unitary structure for retaining a pair of bearing sets axially displaced from one another that support the sorting and lifting wheel shaft, adjacent unitary mounting structure for the drive motor. A separate hopper and lid is attachable to the wall portion at the circular recess that can open and close for loading cartridges and operating the magazine loader.

A feature and advantage of embodiments is utilizing the polymer housing components for the chassis to support the motorized wheel, the loader portion, and the orienting chute thereby providing a robust and light weight electronic magazine loader. In embodiments the weight of the electronic magazine loader as disclosed may be less than 12 lbs. in weight. In embodiments the weight of the electronic magazine loader as disclosed may be less than 10 lbs. in weight. In embodiments the weight of the electronic magazine loader as disclosed may be less than 8 lbs. in weight. In embodiments the weight of the electronic magazine loader as disclosed may be less than 7 lbs. in weight. In embodiments, the electronic magazine loader may be less than 0.90 cu.ft. volumetrically. In embodiments, the electronic magazine loader may be less than 0.80 cu.ft. volumetrically. In embodiments, the electronic magazine loader may be less than 0.70 cu.ft. volumetrically. In embodiments, the electronic magazine loader may be less than 0.60 cu.ft. volumetrically. In embodiments, the electronic magazine loader may have a volume of about 0.50 cu.ft. In embodiments, the electronic magazine loader may have a footprint of less than 80 sq. in. In embodiments, the electronic magazine loader may have a base footprint of less than 75 sq. in. In embodiments, the electronic magazine loader may have a base footprint of less than 100 sq. inches. In embodiments, the electronic magazine loader may have a base footprint of less than 70 sq. inches. In embodiments, the overall footprint including downward projections of any portions that project laterally outwardly beyond the base footprint, is less than 125 sq. in. In embodiments said overall footprint is less than 100 sq. in. In embodiments, said overall footprint is less than 100 sq. in. In embodiments, the electronic magazine loader may have a total height of 18 inches. In embodiments, the electronic magazine loader may have a total height of 17 inches. In embodiments, the electronic magazine loader may have an over height of 16 inches. In embodiments, the electronic magazine loader may have a total height of about 14 inches or less. In embodiments, the electronic magazine loader may have a total height of less than 17 inches, a total weight of less than 7 lbs., a total volume of less than 0.6 sq. ft., and a footprint of less than 80 inches. The above dimensions provide for an easily transportable, desk or bench operable electronic magazine loader.

Base area and the downward projection of any features extending outwardly from the housing that fall outside the base area. A feature and embodiment is an arrangement of components providing a reduced rectangular footprint of the loader with a width and a depth, the depth being greater than the width. The reduced footprint provided by the optimal stacking of components and operating portions.

A feature and advantage of embodiments is a motorized magazine loader with a housing that contains all powered mechanisms, precluding contact with the mechanisms by users or bystanders, the housing efficiently supporting the mechanisms and providing the chassis for supporting the mechanisms, and the housing providing an uppermost user interface.

A feature and advantage of embodiments is a motorized magazine loader that has modular components, such as the chute, that can be changed out for loading different sizes of cartridges.

A feature and advantage of embodiments is a receiving region for disordered cartridges and a hopper that may be closed for operation of the electronic magazine loader. In embodiments the sorting and lifting wheel is completely contained within the housing during operation, eliminating any potential hazards associated with the powered wheel. Sensors and operational lockouts may prevent operation when the top cover is open.

A feature and advantage of embodiments is a motorized magazine loader that is intuitive and easy to operate. A hopper opens up on a side of the device for receiving cartridges, a magazine receiver is positioned on the front wall of the device and has a latch for securing a magazine therein. And the control panel and display is elevated at the top of the loader, angled, and facing the operator.

The above summary is not intended to describe each illustrated embodiment or every implementation of the present disclosure.

BRIEF DESCRIPTION OF THE DRAWINGS

The drawings included in the present application are incorporated into, and form part of, the specification. They illustrate embodiments of the present disclosure and, along with the description, serve to explain the principles of the disclosure. The drawings are only illustrative of certain embodiments and do not limit the disclosure.

Figure 1:
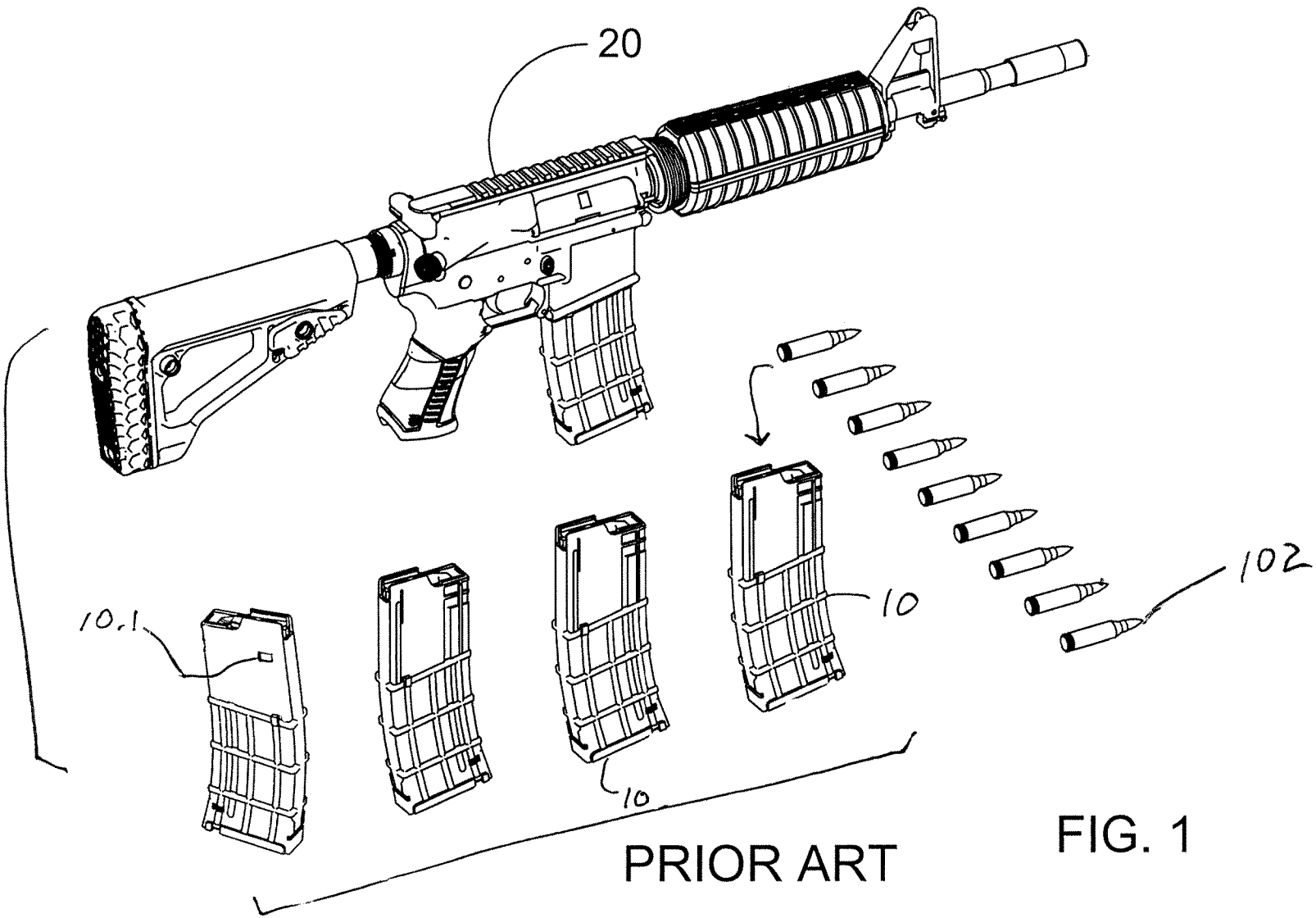
FIG. 1 PRIOR ART
FIG. 1 is a perspective view showing a prior art firearm, a plurality of cartridges and a plurality of magazines for holding cartridges and feeding the cartridges into the firearm.
Figures 2A, 2B:
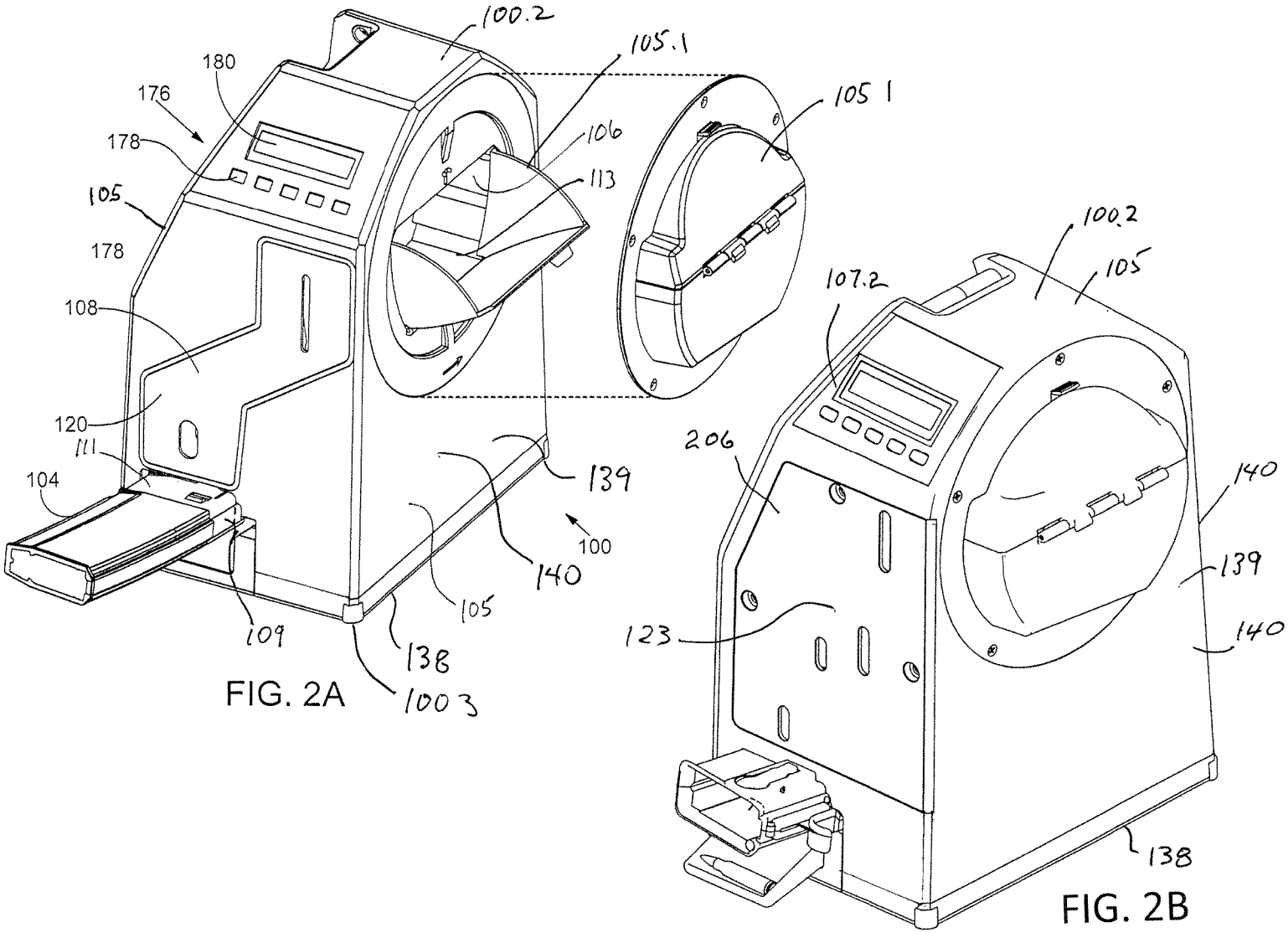
FIG. 2A is a perspective view showing a magazine loader for loading cartridges into a magazine with an alternate hopper portion.
FIG. 2B is a perspective view showing a magazine loader with an alternate chute portion.
Figure 2C:
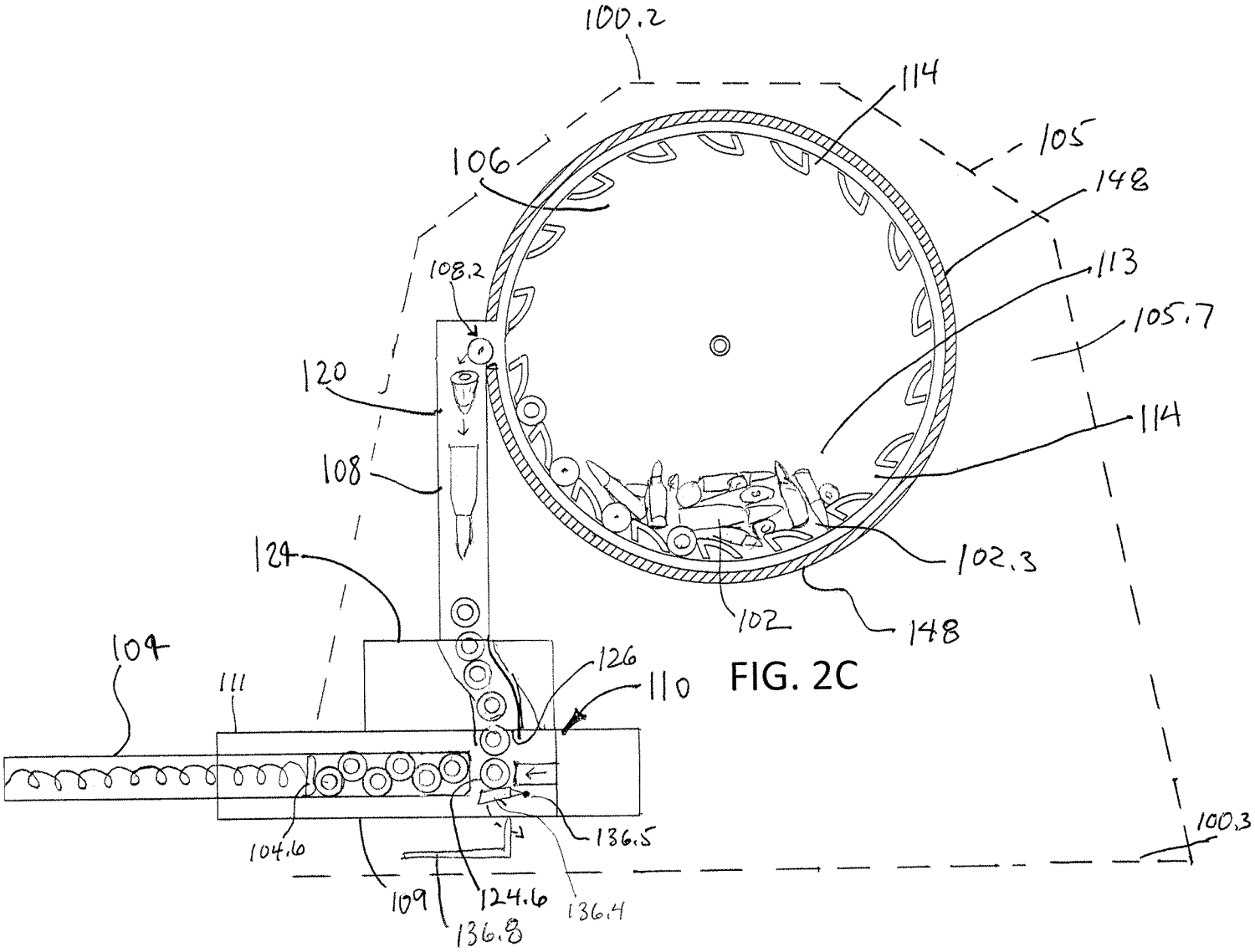
FIG. 2C is a schematic view of a magazine loader according to embodiments.
Figure 2D:
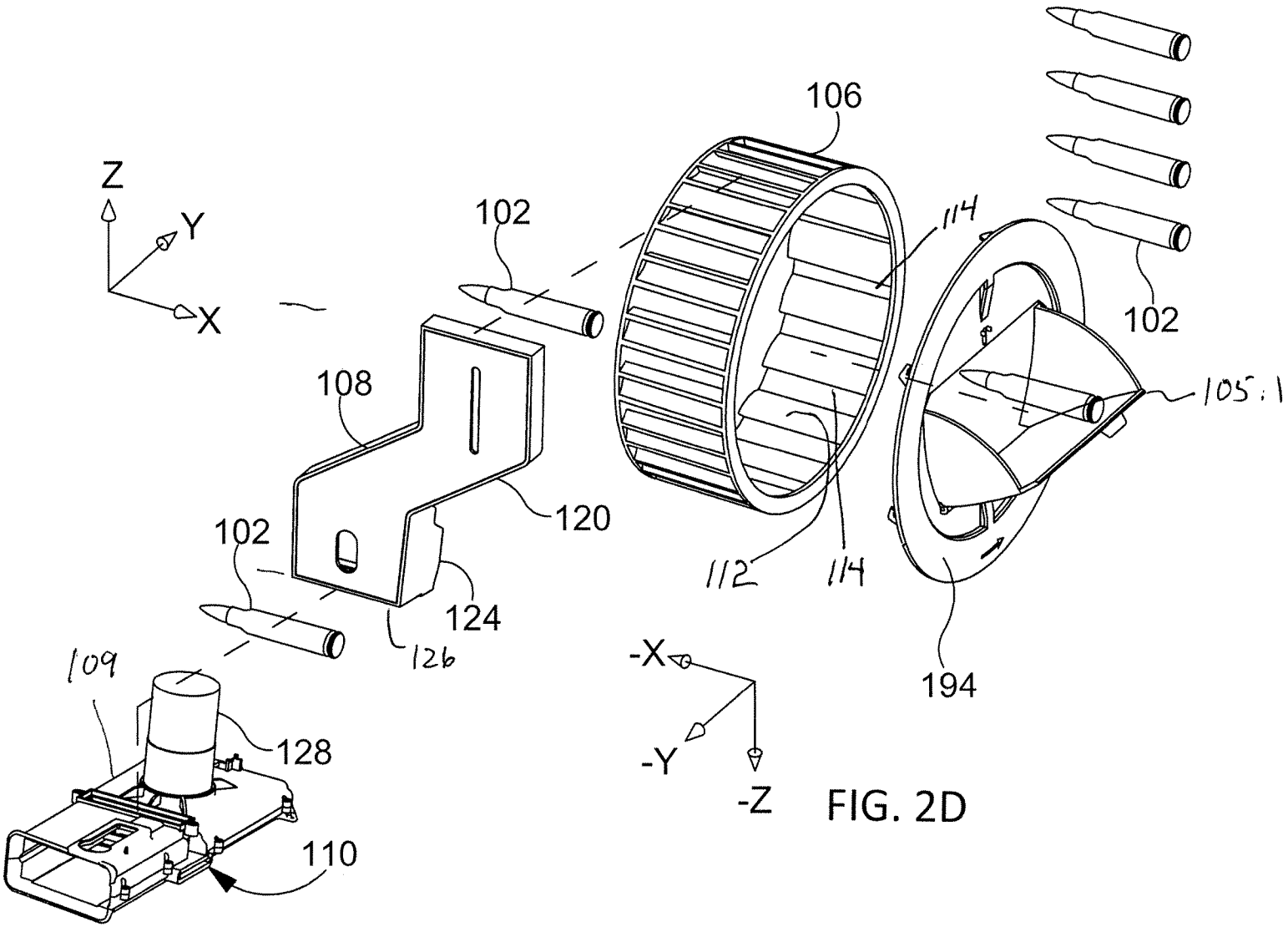
FIG. 2D is an exploded view of a magazine loader showing principle components without the housing.

While embodiments of the disclosure are amenable to various modifications and alternative forms, specifics thereof have been shown by way of example in the drawings and will be described in detail. It should be understood, however, that the intention is not to limit the disclosure to the particular embodiments described. On the contrary, the intention is to cover all modifications, equivalents, and alternatives falling within the spirit and scope of the disclosure.

DETAILED DESCRIPTION

FIG. 1 illustrates a modern sporting rifle 20, such as the rifle commonly known as an AR15, that fires cartridges 102 from loaded magazines 10. The rifle cartridges and the magazines may be, for example, 5.56×45 mm NATO round or a .223 Remington round. AR15 magazines have a notch 10.1 for locking the magazine in the rifle.

Referring to FIGS. 2A-3A, a motorized magazine loader 100 for loading cartridges 102 into a magazine 104 is illustrated. The loader generally comprises a housing 105, a hopper portion 105.1, a motorized wheel as 106, operating circuitry 107 including a user interface 107.2, a chute 108, and a magazine loading portion 109 that includes a motorized pusher mechanism 110 and a magazine receiver 111. The loader has a cartridge receiving region 113 defined by an open interior 112 of the wheel.

Referring to FIGS. 2A-3B, the magazine loader 100 has a top 100.2, a bottom 100.3 and includes a housing 105 including a housing base 138 and a housing enclosure 139 fixed thereto, the housing enclosure 139 including exterior wall portions 140. The housing defining a housing interior 105.7.

Figure 3A:
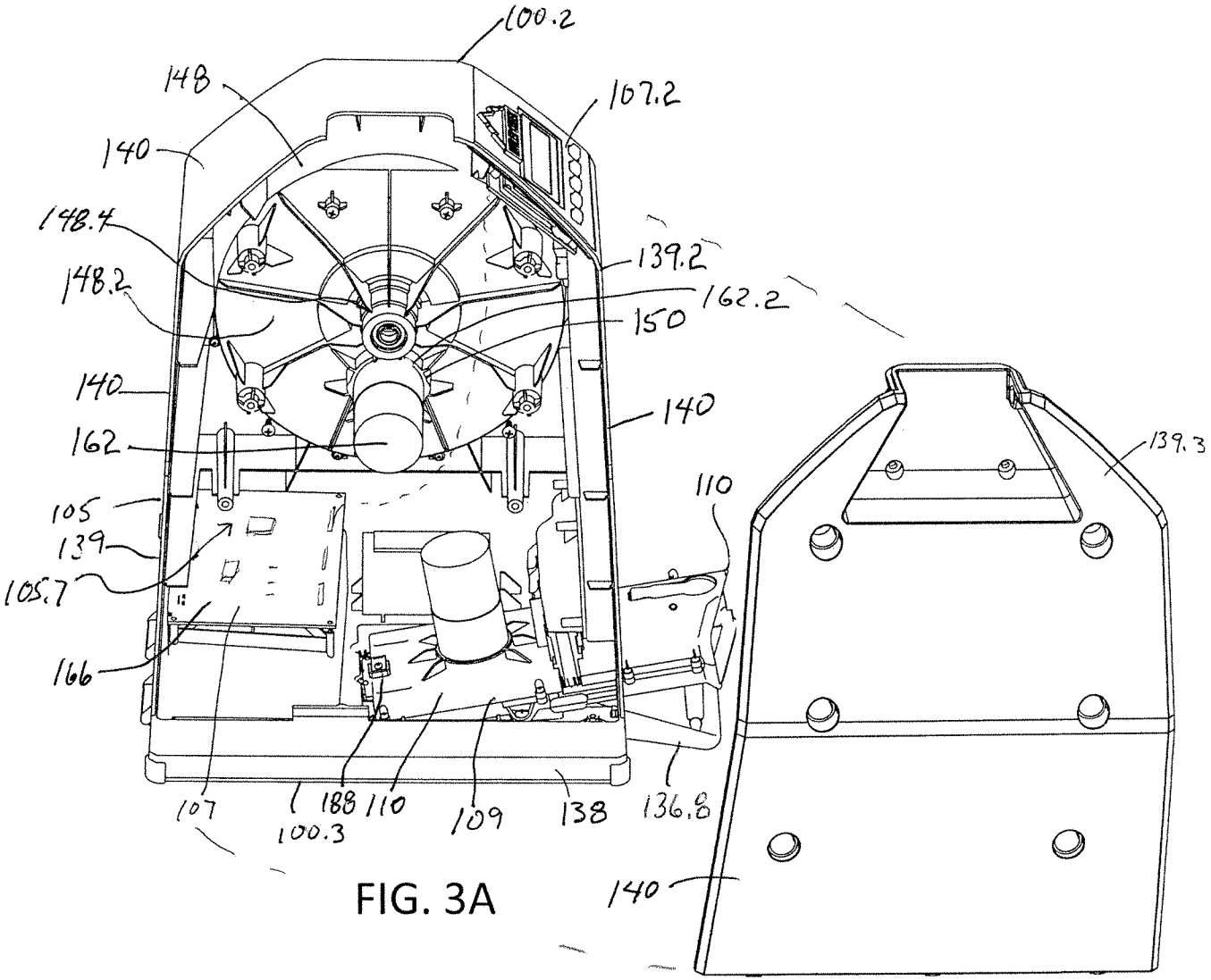
FIG. 3A is perspective view showing an embodiment of the magazine loader with a side wall of the housing enclosure removed.
Figure 3B:
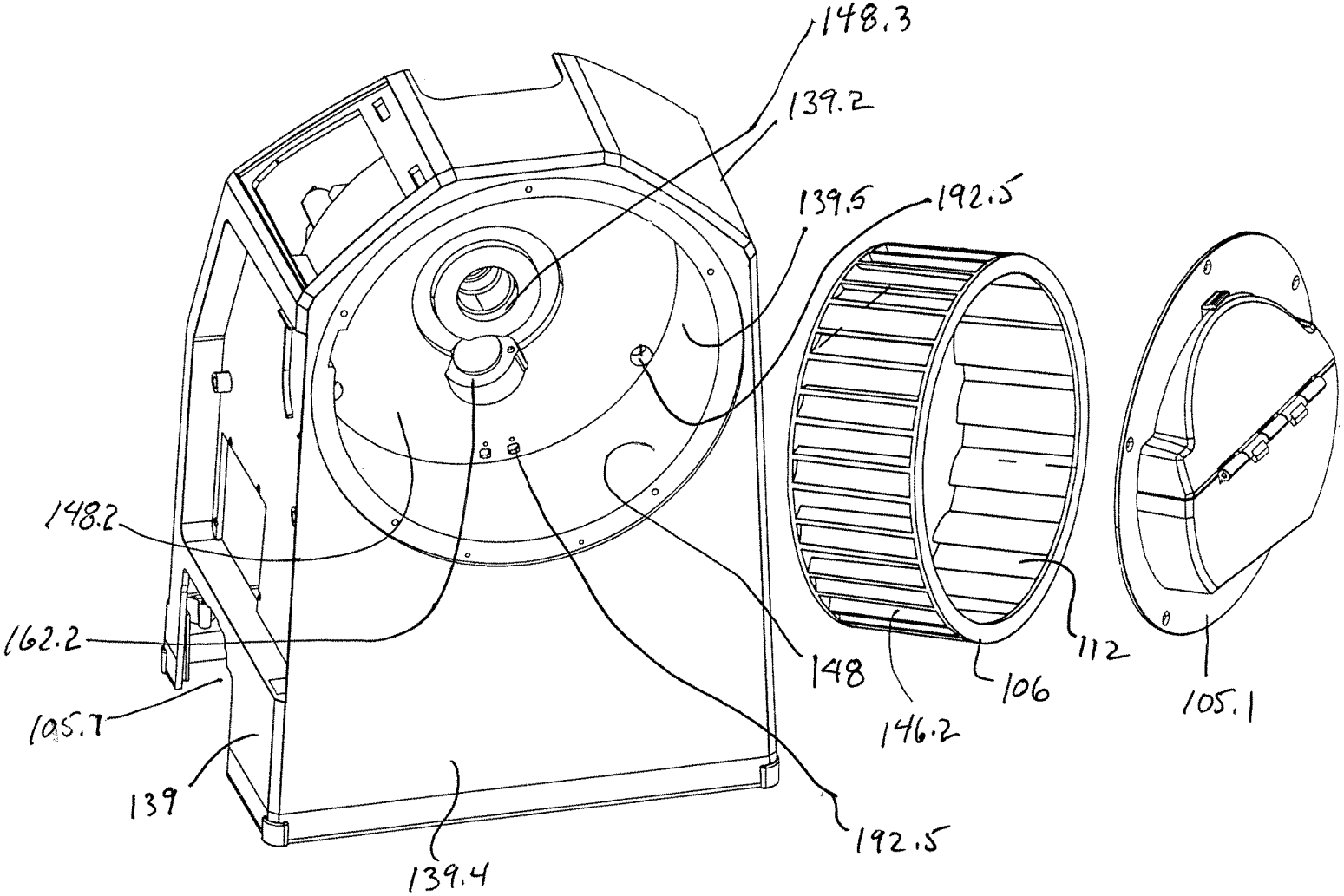
FIG. 3B is a perspective of a housing for a magazine loader depicting the wheel recess for receiving the wheel and hopper portion.
Figure 4:
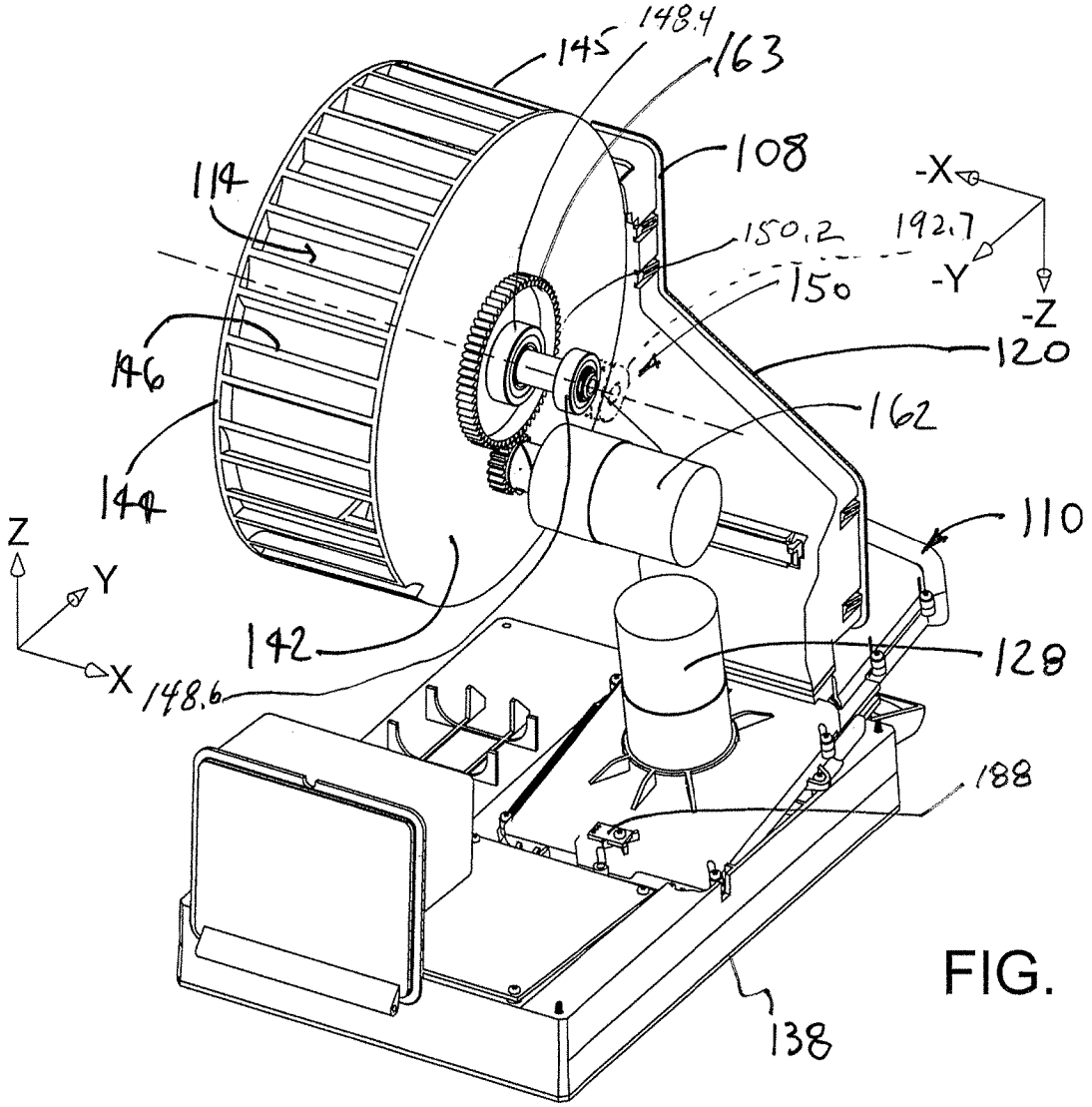
FIG. 4 is a perspective view showing components of a magazine loader on a base.
Figure 5:
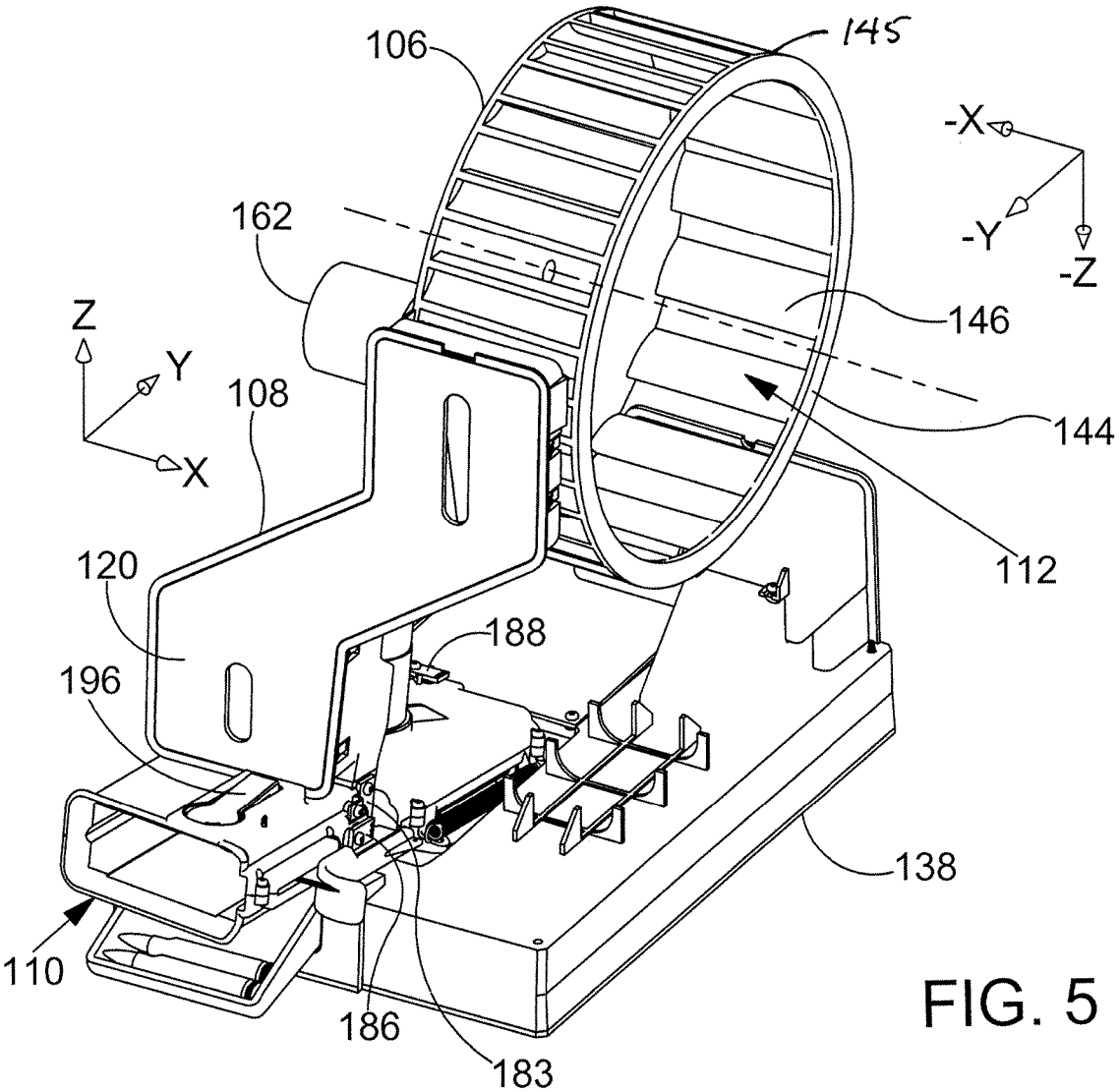
FIG. 5 is a different perspective view of the magazine loader assembly of FIG. 4.
Figure 6:
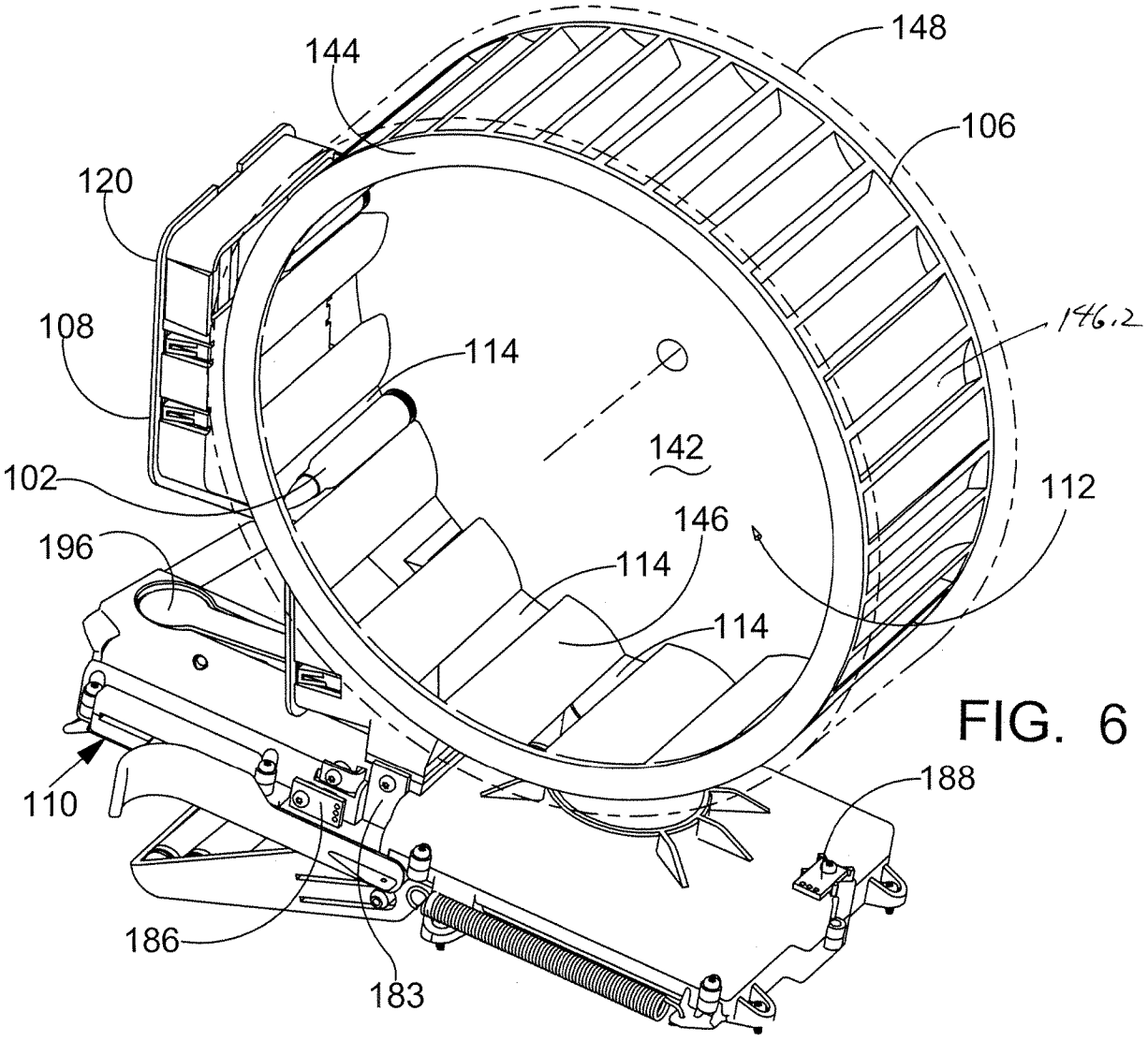
FIG. 6 is a perspective view showing a magazine loader assembly including a wheel, a chute, and a cartridge loading portion with a cartridge being lifted by the wheel.
Figure 8:
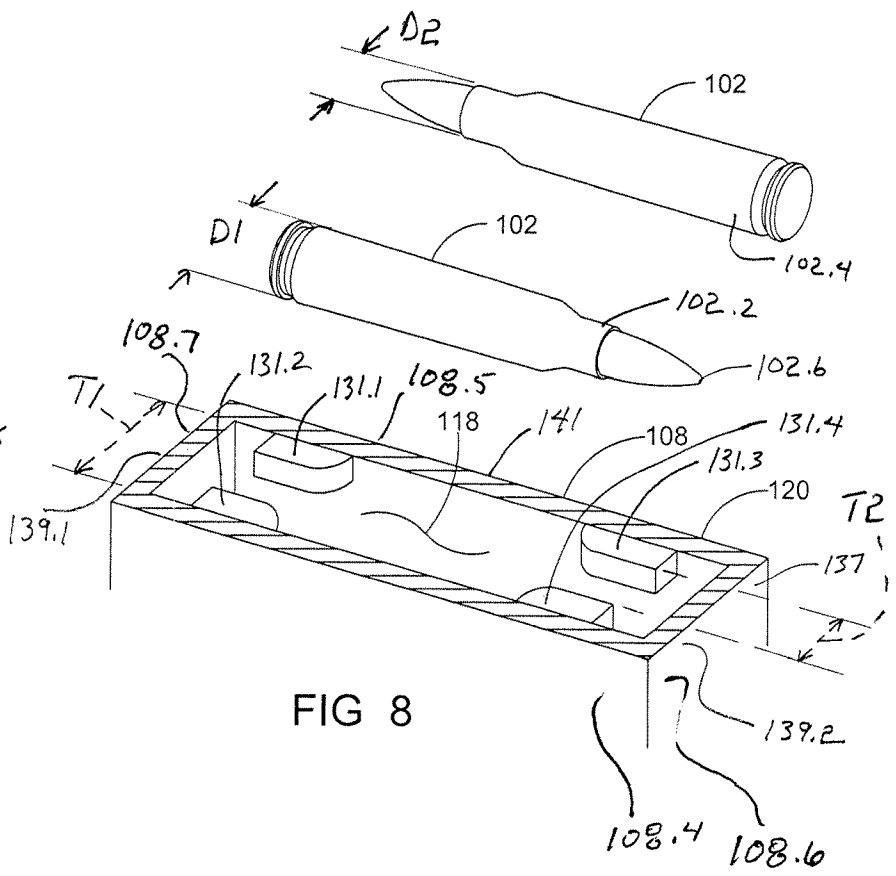
FIG. 8 is a cross sectional perspective view of the upper portion of a chute.
Figure 7:
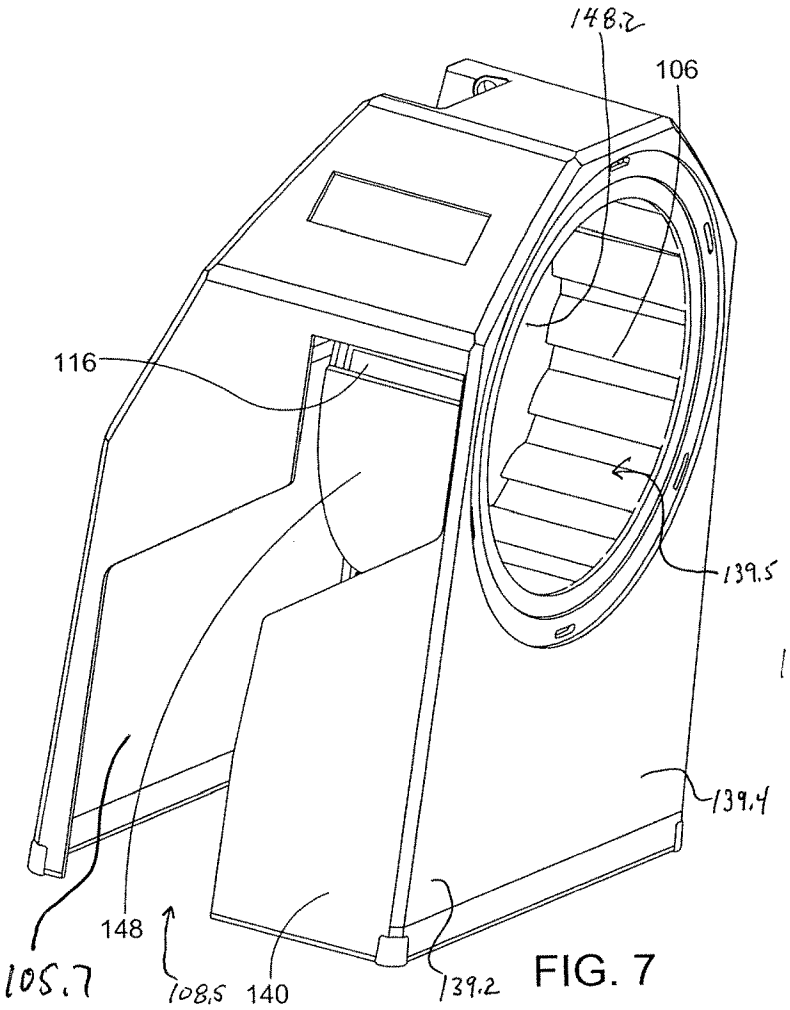
FIG. 7 is a perspective view showing a magazine loader housing including a cylindrical wall defining a wheel discharge slot and with a wheel in place.

The upper housing enclosure may comprise a three sided housing enclosure portion 139.2 fixed to the base 138, and a housing side wall portion 139.3 as best shown in FIGS. 3A and 3B. Removal of the side wall portion 139.3 allowing access to the housing interior 105.7 and to internal componentry. The three sided unitary housing enclosure portion 139.2 includes a middle wall portion 139.4 that has a circular recess 139.5 defined by a cylindrical wall portion 148 and a wall plate portion 148.2 traversing the cylindrical wall portions 148, best shown in FIGS. 3A and 3B. As illustrated in FIG. 3B the wheel 106 is received in the circular recess 139.5. The housing components may be formed by injection molding.

As illustrated best in FIGS. 2A-2C and 3A-3B, the housing has a taper in the upward direction. That is, the cross-section area taken in a horizontal plane generally decreases in an upwardly direction.

Referring to FIGS. 2C-7, the wheel has circumferentially spaced singularizing pockets 114 for receiving and lifting cartridges serially in a continuous stream from an unordered batch 102.3 of cartridges loosely placed inside the open interior 112 of the wheel 106.

The wheel 106 comprises a hub portion configured as a hub plate 142, an outer ring 144 at a wheel periphery 145, and a plurality of lifting shelves 146 extending between the hub plate 142 and the outer ring 144. The shelves 146 of the wheel 106 and the cylindrical wall 148 of the housing 105 define the plurality of cartridge receiving pockets 114.

In embodiments, the wheel 106 is configured to singularize the cartridges of the batch (without orienting the tip direction of the cartridges) while raising them serially to a wheel discharge slot 116 defined by an opening or window in the cylindrical wall 148. In embodiments, the slot 116 leads into a passageway 118 of the chute portion 108.

Referring to FIGS. 3A-6, a wheel drive 150 including drive train 150.2 is configured to rotate the wheel 106 and the cartridges are thereby circulated in the wheel interior 112 as the wheel 106 rotates. In embodiments, the chassis and housing 105 rotatably supports the wheel 106 as well as the drive motor 162 for the wheel 106 or at unitary motor mount 162.2. The wall plate portion traversing the opening defined by the cylindrical wall and providing drive train mounts for rotating the wheel. The wall plate portion 148.2 may have unitary bearing retention structure 148.3, 148.4 for retaining a pair of bearing sets 148.5, 148.6 axially displaced from one another that support the sorting and lifting wheel shaft, adjacent to the unitary motor mount structure 162.2 for the drive motor.

Referring to FIGS. 2A-2D and 7, the sorting and lifting wheel 106 operates a follows. A batch 102.3 of disordered cartridges are placed in the cartridge receiving region 113. As the wheel rotates individual cartridges are received in the cartridge receiving pockets 114 of the wheel. The cylindrical wall 148 defines a wheel discharge slot 116 positioned to communicate with a passageway 118 defined by a chute body 120. In embodiments, the slot may be placed, with reference to a clock face, at 9:30 to 10:30. In embodiments, at 9:00 to 11:00. Each of the shelves 146 are oriented such that a ramp 146.2 is defined sloping downwardly toward the wheel discharge slot when the shelf is positioned at the wheel discharge slot 116. This angular orientation assists the shelf to grab a cartridge as the wheel rotates through the unordered batch of cartridges in the interior 112 of the wheel. In embodiments, each shelf being sized to grab and retain only a single cartridge in the respective pocket see FIG. 5. The wheel 106, as it is rotated, lifts the cartridges up to the wheel discharge slot 116. As each cartridge receiving pocket 114 becomes aligned with the wheel discharge slot 116, the cartridge rolls or falls out of the cartridge receiving pocket 114, through a wheel discharge slot 116, and into the chute 108 see FIG. 7. Each cartridge that is received in one of the cartridge receiving pockets 114 may have a random one of a first orientation and an opposite second orientation, that is, the cartridge tips will be pointing in opposite directions.

Figures 9, 10:
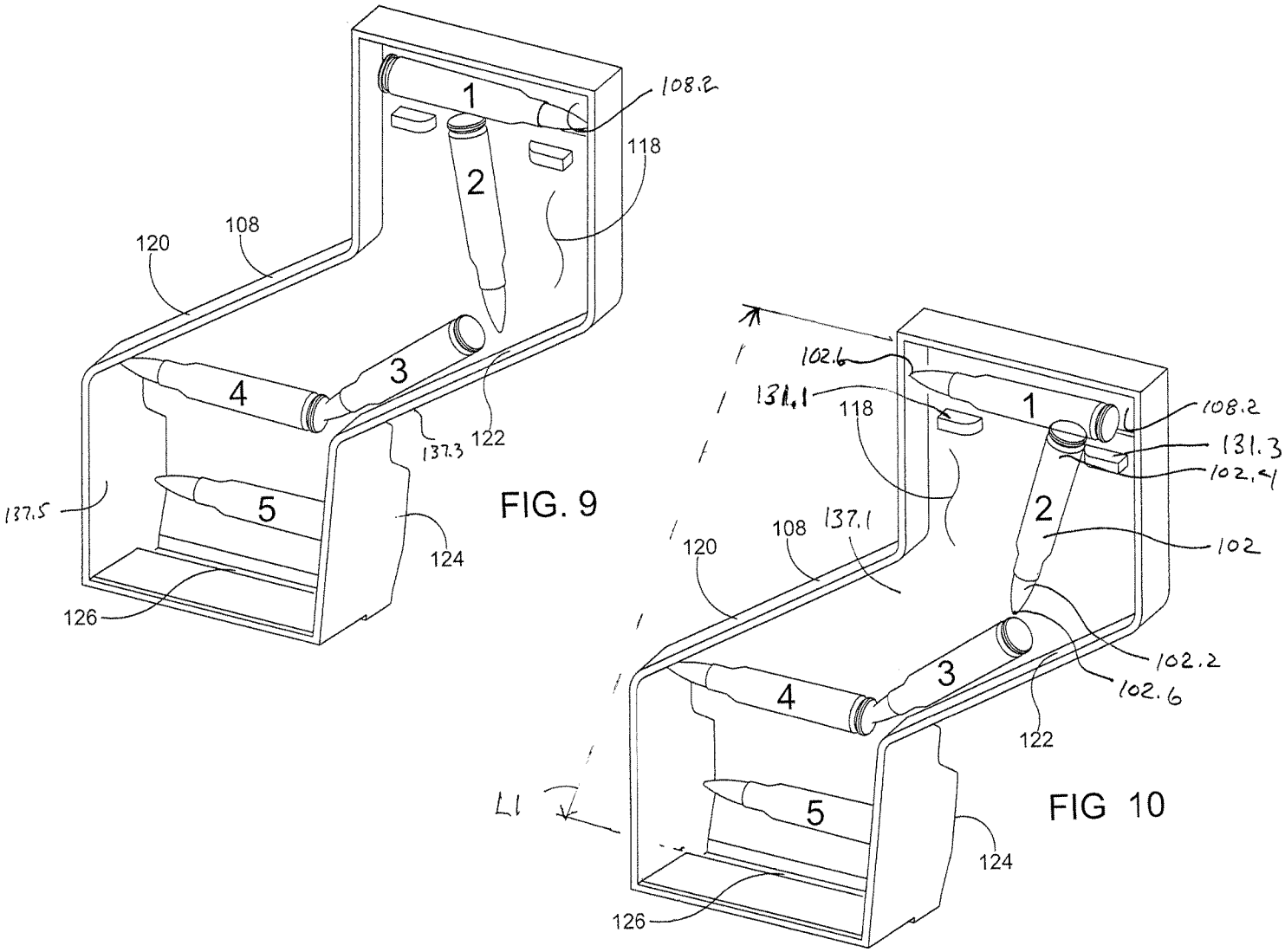
FIG. 9 is a perspective view showing a chute with cartridges and without an exterior chute panel in place.
FIG. 10 is a perspective view showing a chute with cartridges and without an exterior panel in place.

As the cartridges pass through slot 116 they enter the chute 108 at opening 108.2. Referring to FIGS. 2A-2D, and 7-10, an exemplary chute 108 formed of a chute body 120 is configured so that the horizontal aligned and randomly directed cartridges are arranged to be in a common orientation as they fall, that is by the force of gravity, through the passageway 118 defined by the chute body 120. The chute 108 generally has an open passageway thickness T1 slightly greater than a maximum diameter D1 of the cartridge as defined by the casing at the rearward end of the cartridge. See in particular FIG. 8. This passageway thickness T1 generally extends substantially the vertical length L1 of the chute passageway, with the passageway having a rectangular cross-section. The chute having four upwardly extending chute walls 108.4, 108.5, 108.6, 108.7 defining the passageway and being configured as a removable unit. The unit having an s-shape and the housing may have a slot 108.5 or recess to receive the chute, see FIG. 7. The chute having an upper portion 137 with an opposing restrictive structures 131.1, 131.2, 131.3, 131.4 displaced from the chute entry slot 108.2 that effectively narrows the passageway thickness to a lesser thickness T2 of the chute on each of two sides 139.1, 139.2 of the chute, but does not narrow the thickness of the passageway in a central portion 141 of the upper portion 137. The restrictive structures sized to allow the forward end 102.2 of the cartridge 102, due to the reduced diameter D2 of the cartridge forward end, to fall downward but prevents the cartridge rearward end 102.4 to pass through the restrictive structures due to the increased diameter D1 of the rearward end 102.4. Referring specifically to FIGS. 9 and 10, as the forward end falls the cartridge rotates such that the rearward end is upwardly from the forward end and the rearward end becomes more centered in the upper portion 137 where there is no restrictive structure allowing the cartridge to fall, forward end, tip end, first into the mid-portion 137.1 of the chute. The shape of the chute is narrowed such that the cartridges cannot rotate about a horizontal axis that is generally perpendicular to the plane of the chute. An angled portion 137.3 of the chute sweeps in a direction that the tips 102.6 of the bullets are to point thereby general orienting the cartridges to be horizontal such that the cartridges move laterally to the accumulator portion of the chute where they may be stopped by wall 137.5 and they fall downwardly while generally maintaining their horizontal orientation. This provides the cartridges in a vertical stack with all the cartridges pointing with their tips in the same horizontal direction in the accumulator portion 124 ready for insertion into the magazine. The chute having a singular exit slot 126. A lower most cartridge position 124.6 is provided at the bottom of the accumulator portion. Such position may be defined by chute structure or be below the chute body. The chute may be formed of injection molded polymers.

Figure 11:
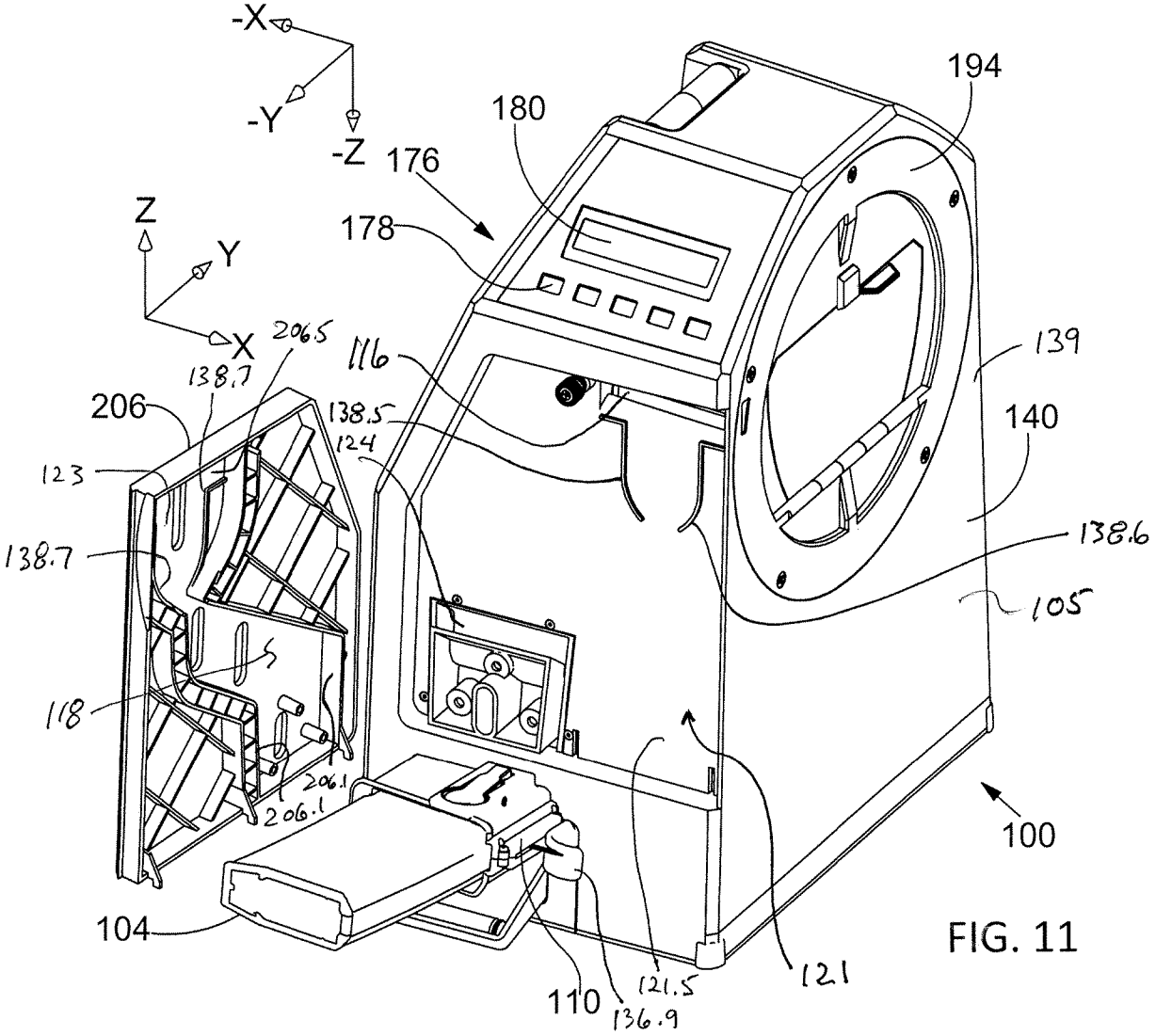
FIG. 11 is a perspective view of a magazine loader for loading cartridges into a magazine. The magazine loader of FIG. 11 includes a housing and a removable panel that may be detachably attached to the housing and that provides the gravity fed the chute portions.
Figures 12A, 12B, 12C:
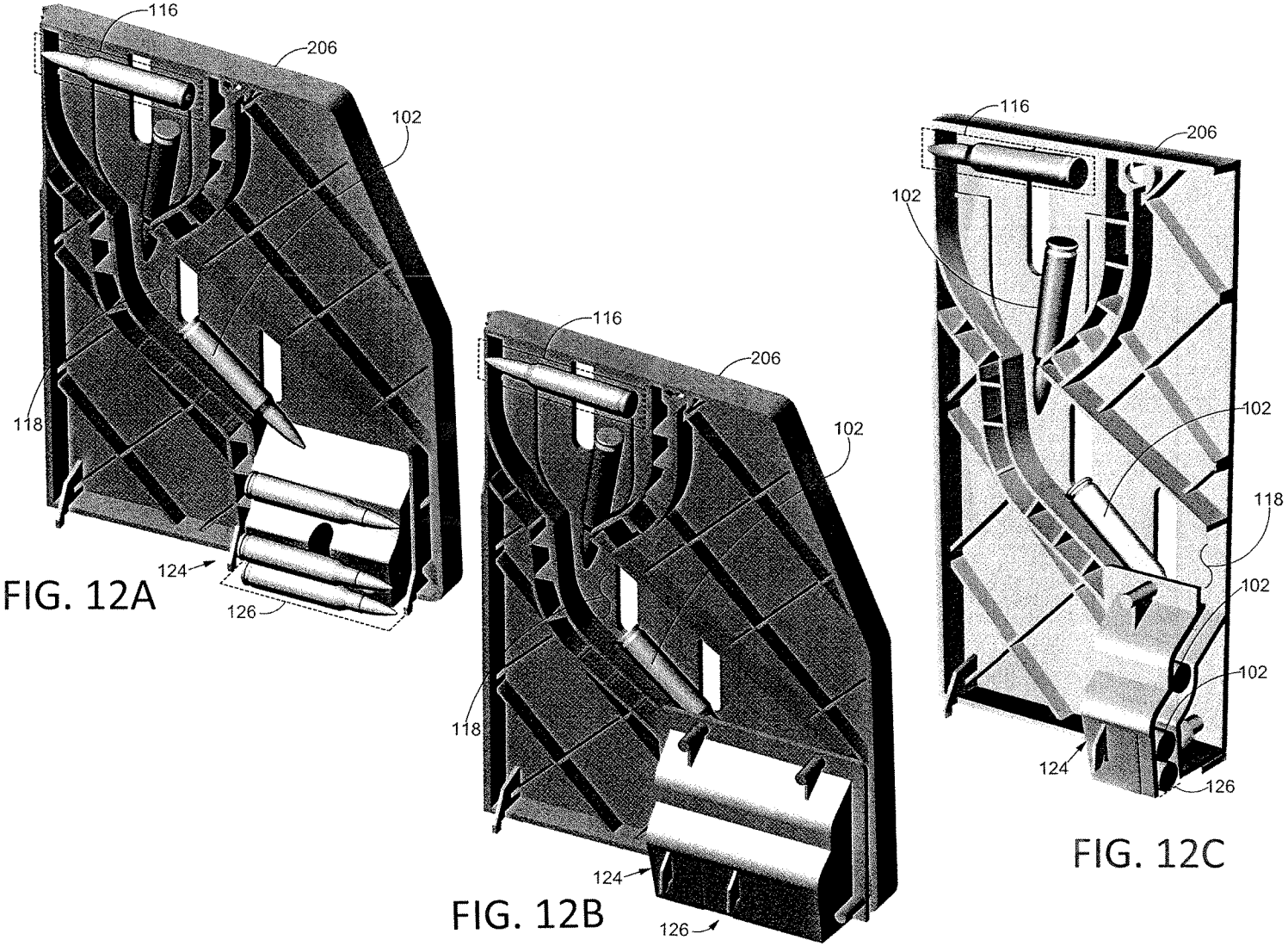
FIG. 12A is a perspective view showing a removable panel that may be detachably attached to the housing of a magazine loader.
FIG. 12B is a perspective view showing a removable panel that may be detachably attached to the housing of a magazine loader with cartridges falling and becoming oriented.
FIG. 12C is a perspective view showing a removable panel that may be detachably attached to the housing of a magazine loader with cartridges falling and becoming oriented.
Figure 14:
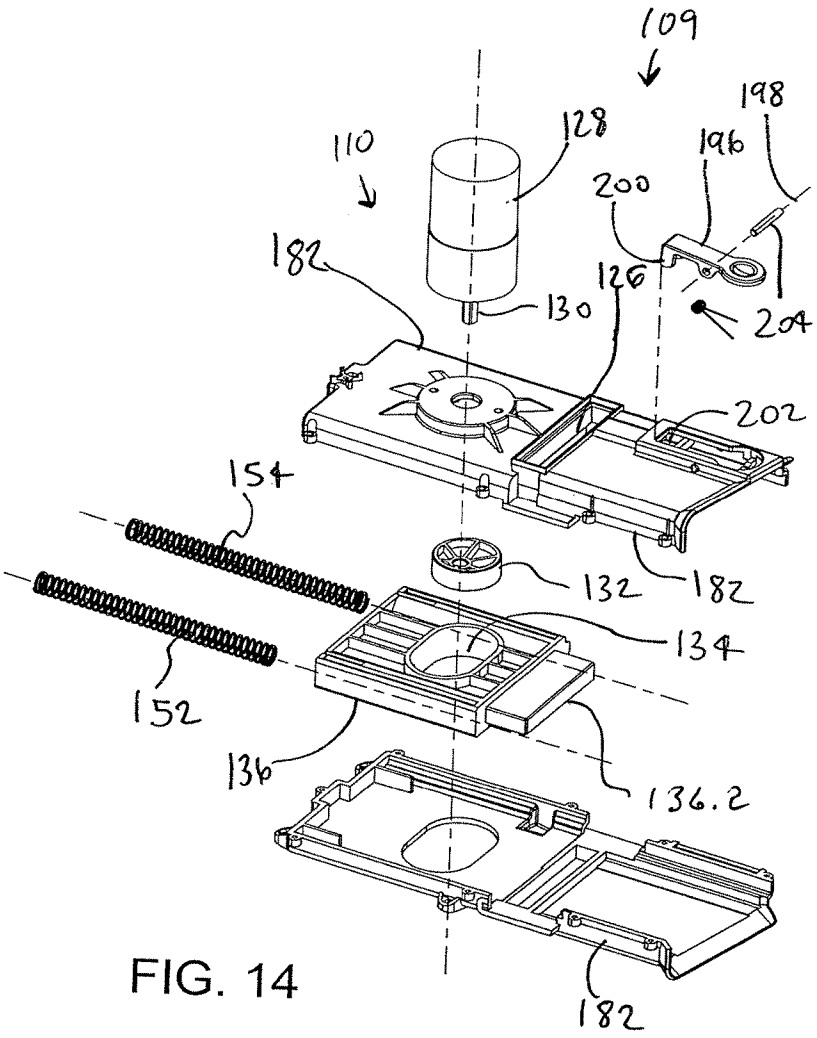
FIG. 14 is an exploded perspective view of the pusher mechanism of FIG. 13 from a different position.
Figure 13:
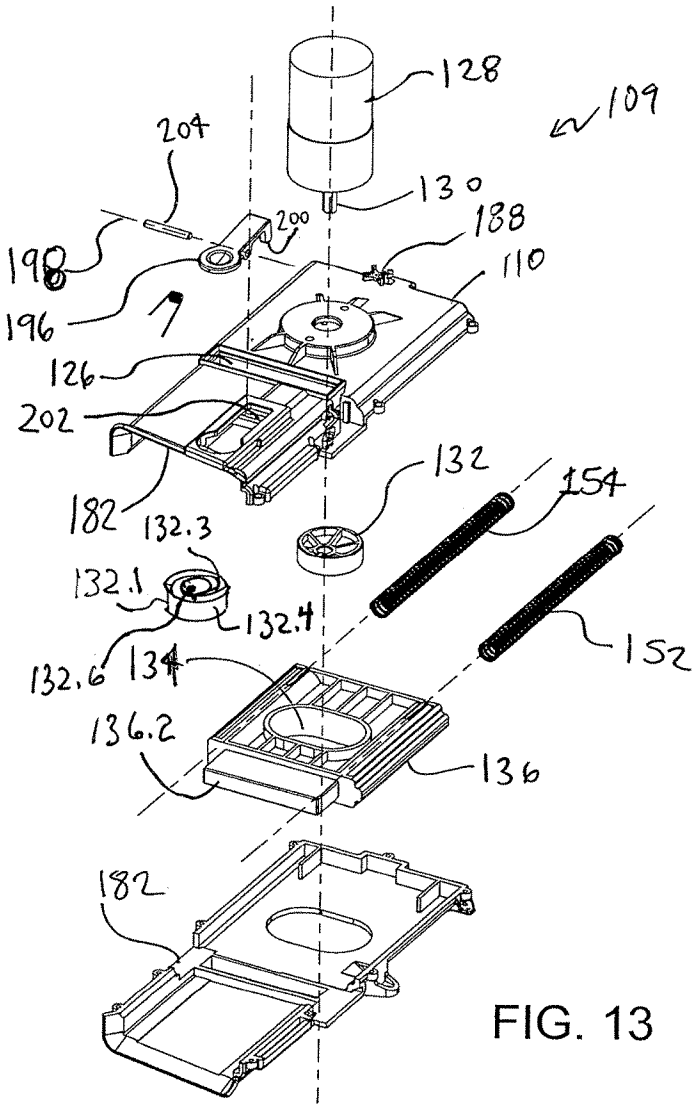
FIG. 13 is an exploded perspective view of a pusher mechanism including a pusher and two springs that apply spring forces to the pusher.

Referring to FIGS. 11-12C, an embodiment with a different forward wall chute configuration is illustrated. The housing 105 has a chute panel recess 121 with the wheel discharge slot 116 positioned at the top of the recess. The recess is defined by an inward insert wall portion 121.5 of the upper enclosure 139. A chute panel 206.1 is removably placeable in the recess whereby chute wall structure 206 on the panel and the inwardly insert wall portion 121.5 combine to define the chute 123.

In this embodiment the opposing restrictive structures 138.5, 138.6, 138.7 and 138.8 are configured as ribs projecting from the wall portion 121.5 and the chute panel 206. The ribs initially projecting inwardly and horizontally at the lateral ends 206.4 and 206.5 of the passageway 118.4 and then extend downwardly and convergingly inwardly with a smooth curvature inwardly. In embodiments the ribs are generally U-shaped. In embodiments each upward leg of the U having an outwardly extending horizontal foot portion and the bottom of the U is open.

The chute panel may be transparent and/or have slots for viewing the passageway and any cartridges therein. The chute panel may be formed from injection molded polymers, for example polycarbonate or polystyrene.

Referring to FIGS. 3A-6 and 11, 13-14, in embodiments, a series of single cartridges is fed, one by one, through the singular exit slot 126 and into the pusher mechanism 110. In embodiments, the pusher mechanism 110 comprises a pusher motor 128 a having a drive shaft 130 and a cam member 132 fixed to the drive shaft 130. The cam member 132 is received in a cam follower with a cavity 134 defined by a pusher 136 of the pusher mechanism 110. The cam member 132 is shaped so that the pusher 136 oscillates in a first direction away from the magazine 104 and a second direction toward the magazine 104 as the cam member 132 rotates in the cam follower cavity 134. As the pusher 136 oscillates, a series of single cartridges are feed, one by one, through the singular exit slot 126. The plunger portion 136.2 of the pusher mechanism 110 pushes the series of single cartridges, one by one, in a direction transverse to the stack, into a captured magazine 104 where the cartridges are received with the magazine spring loaded follower 104.6 retracting. In an embodiment, see FIG. 13, there can be a peak load absorbing spring as part of the drive system for the pusher mechanism. For example, an alternate cam member 132.1 may include a spring member 132.3 extending between an inner hub 132.6 and an outer member 132.4 that counterbalances the loading pressure as the pusher loads a cartridge in a magazine. This provides a significant load reduction on the motor allowing for use of a smaller, lighter, and less powerful motor.

A first spring 152 and a second spring 154 of the pusher mechanism 110 may be seated against the pusher 136. The first spring applies a first spring force to the pusher 136 and the second spring 154 applies a second spring force to the pusher 136 both generally toward the magazine 104.

Referring to FIGS. 13-16, the pusher mechanism 110 of the magazine loader portion 109 may further include a magazine receiver 182 defining a cavity 184 extending along a magazine receiving and withdrawal axis and a magazine retention mechanism comprising a lever 196 pivotally supported by a wall of the magazine holding body. In embodiments, the lever 196 is pivotable about a pivot axis 198. In embodiments, the lever 196 has an actuating portion disposed on a first side of the pivot axis 198 and a blocking member 200 disposed on a second side of the pivot axis 198. In embodiments, the blocking member 200 of the lever 196 is dimensioned and adapted to be received in the complementary interlocking feature, the notch 10.1, of the magazine 104, see FIG. 1. In embodiments, the lever 196 is positioned so that the blocking member 200 extends through an aperture 202 defined by the magazine holding body 182. In embodiments, the lever pivots about a pin 204 that is supported by a wall of the magazine holding body 182. In embodiments, the lever 196 is selectively pivotable between a blocking position in which the blocking member 200 of the lever 196 is received in the complementary interlocking feature of the magazine 104 and a non-blocking position in which the blocking member 200 of the lever 196 is located outside of the complementary interlocking feature of the magazine 104.

A release gate 136.4 may partially define the lowermost cartridge position 124.6 and may be released by a lever 136.9, for example when the magazine is full and there is a stack of cartridges in the accumulator portion. The gate may pivot about a pivot point 136.5 or may slide out of position when the lever is pulled opening the gate. A tray 136.8 below the gate 136.4 may guide the cartridges forward to be collected by the operator.

Referring to FIGS. 3A, 15-24, the magazine loader 100 may further include circuitry 107 operatively coupled to the pusher motor 128 of pusher mechanism 110 and a wheel drive motor 162 of the wheel drive 150, wherein the circuitry 107 comprises one or more processors and a non-transitory computer readable medium storing one or more instruction sets. In embodiments, the one or more instruction sets include instructions configured to be executed by the one or more processors to cause the magazine loader to rotate the wheel so that the wheel singularizes (but doesn't orient) the cartridges of the batch while raising them one by one to a wheel discharge slot and the cartridges are transferred, one by one, through the wheel discharge slot and into a passageway defined by a chute body. In embodiments, the one or more instruction sets include instructions configured to be executed by the one or more processors to cause the magazine loader to oscillate the pusher mechanism to push a series of single cartridges, one by one, in a direction transverse to the stack, into a captured magazine. In embodiments, the one or more instruction sets include instructions configured to be executed by the one or more processors to cause the magazine loader to monitor a current drawn by the pusher motor 128 of the pusher mechanism 110 and cut off a current flow to the pusher motor 128 if the current drawn by the pusher motor 128 is greater than a preselected threshold in order to prevent damage to the magazine loader 100. In embodiments, the one or more instruction sets include instructions configured to be executed by the one or more processors to cause the magazine loader to monitor a current drawn by the wheel drive motor 162 of the wheel drive 150 and cut off a current flow to the wheel drive motor 162 if the current drawn by the wheel drive motor 162 is greater than a preselected threshold in order to prevent damage to the magazine loader 100.

Referring to FIGS. 13-15 and 30, in embodiments, the pusher mechanism 110 of the magazine loader 100 further includes a pusher detector 188 for detecting the presence of a pusher 136 in a home position of the pusher 136. In embodiments, the pusher detector 188 is supported by the magazine holding body 182. In embodiments, the pusher detector 188 comprises a optical sensor having a light source 156 and a light sensor 158. In embodiments, the light source 156 comprises a light emitting diode (LED) and the light sensor 158 comprises a phototransistor. In embodiments, the light source 156 emits a light emission and the light source is positioned such that the light emitting by the light source 156 travels into a cavity defined by the magazine holding body 182. In embodiments, the light sensor 158 provides a signal responsive to light reflected off of the pusher 136 when the pusher 136 is present in its home position.

Referring to FIGS. 15-24, in embodiments, the pusher mechanism 110 of the magazine loader 100 further includes a cartridge detector 183 configured as an optical sensor for detecting the presence of a cartridge 102 in a cartridge receiving area. In embodiments, the cartridge detector 183 is supported by the magazine holding body 182 of the pusher mechanism 110. In embodiments, the cartridge detector 183 is an optical sensor that comprises a light source 156 and a light sensor 158. In embodiments, the light source 156 emits a light emission and the light source is positioned such that the light emitted by the light source 156 travels into the cartridge receiving area. In embodiments, the light sensor 158 provides a signal responsive to light reflected off of a cartridge 102 when a cartridge 102 is present in the cartridge receiving area. Detectors herein can be other than optical sensors, for example such detectors could be inductive sensors or could be mechanical micro switches.

Referring to FIGS. 17-23, the magazine loader 100 may also include a door detector 190 useful for determining whether or not the door 194 is in a closed position. In embodiments, the door 194 is coupled to a rod 210 such that the door 194 and the rod 210 pivot relative to the housing. In embodiments, the door detector 190 is supported by the housing 105 of the magazine loader 100. In embodiments, the door detector 190 comprises a light source 156 and a light sensor 158. In embodiments, the light source 156 emits a light emission and the light source is positioned such that the light emitting by the light source 156 selectively illuminates an ear 208 that is fixed to the rod 210. In embodiments, the light sensor 158 provides a signal responsive to light reflected off of the ear 208 when the door 194 is in its closed position. In embodiments, the light source 156 comprises a light emitting diode (LED) and the light sensor 158 comprises a phototransistor.

Referring to FIGS. 16-18, 23, the magazine loader 100 may also include a first wheel rotation detector 192A and a cartridge presence sensor 192B. In embodiments, the wheel rotation detector 192A provides signals from which it may be inferred that the wheel 106 is rotating. For example, in embodiments, the wheel 106 has a plurality of indicators 212 and each wheel rotation detector 192A comprises a light source 156 and a light sensor 158. In embodiments, the light source 156 of each wheel rotation detector 192A is positioned such that light emitted by the light source 156 momentarily illuminates individual indicators 212 as the wheel 106 rotates. The indicators may be colored or mirrored strips that contrast with the background color of the wheel. In embodiments, the light sensor 158 of each wheel rotation detector 192A provides a signal responsive to light reflected off of the series of individual indicators 212 when the wheel 106 is rotating. The receipt of the signals may be timed by processors in the circuitry for confirming the wheel is rotating normally and for detection of an abnormality in the rotation indicative of a jam. In embodiments, each wheel rotation detector 192A may be supported by the housing of the magazine loader 100, for example at sensor apertures 192.5 on the wall plate portion 148.2, see FIG. 3B. Alternately a rotary encoder 192.7 may be attached to the wheel or wheel drive train 150.2 to monitor the wheel rotation. See FIGS. 4 and 17.

The cartridge presence sensor 192B may be, for example an inductive sensor that can detect the presence or lack of cartridges in the open receiving region of the wheel. This sensor is connected to a processor of the circuitry and can shut down the wheel drive motor and/or provide a signal through the user interface of "empty". The sensor can be attached to the housing, for example at sensor apertures 192.5 on the wall plate portion 148.2.

Figure 16:
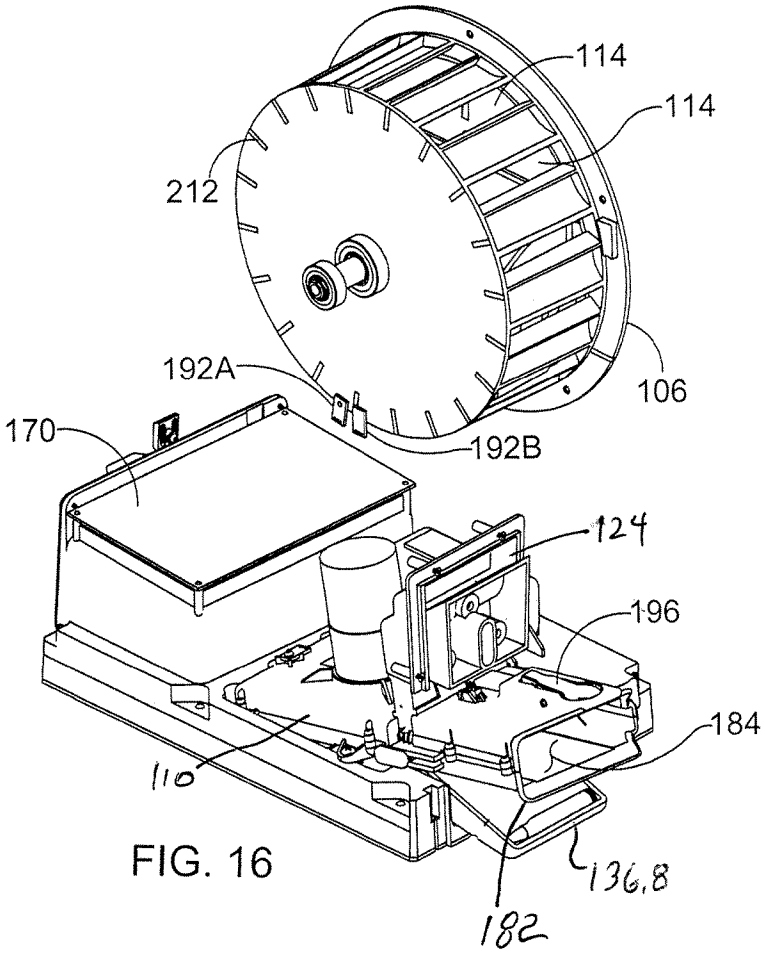
FIG. 16 is a diagram showing a magazine loader system.
Figure 15:
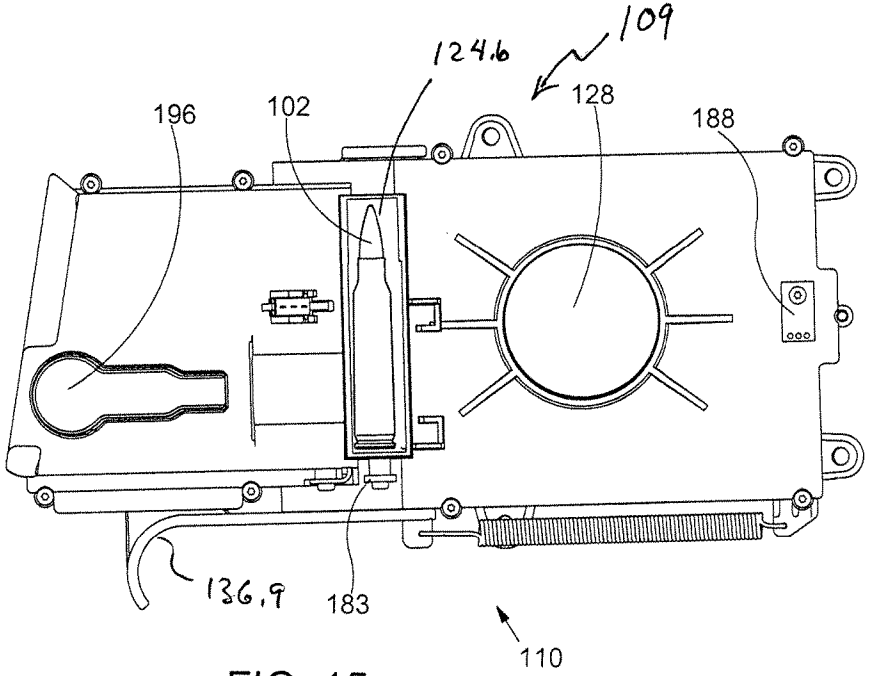
FIG. 15 is a diagram/schematic showing a magazine loader system.
Figure 17:
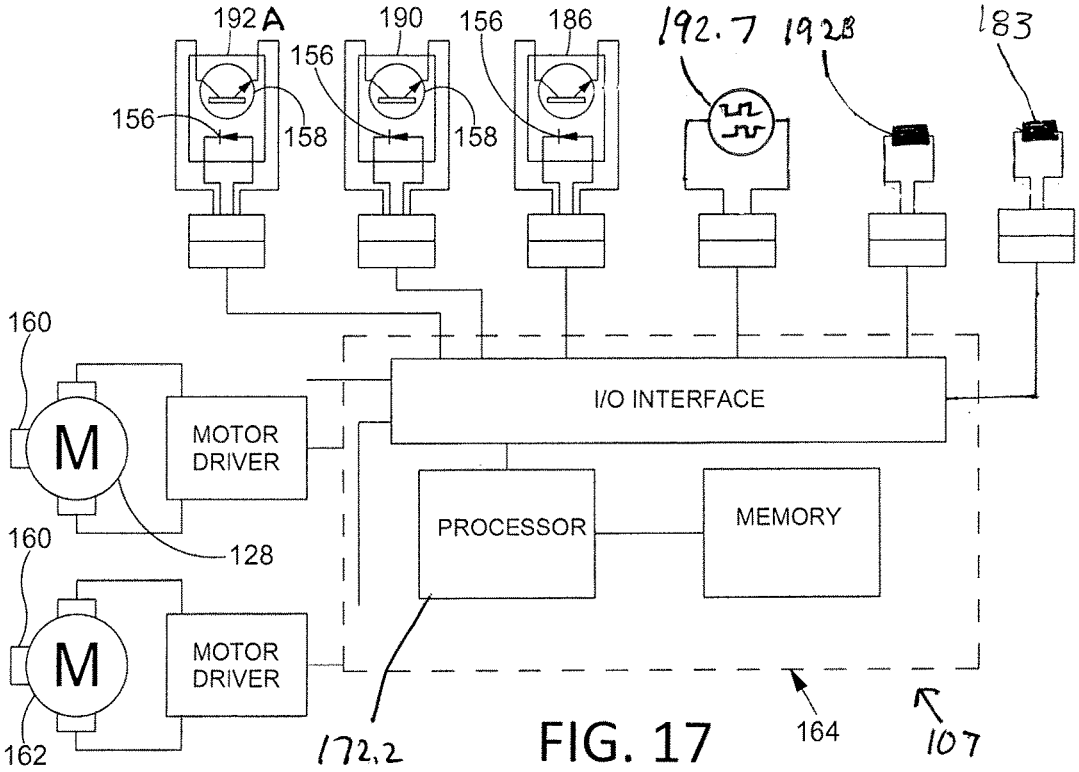
FIG. 17 is a stylized schematic of the control/operating circuitry.
Figure 18:
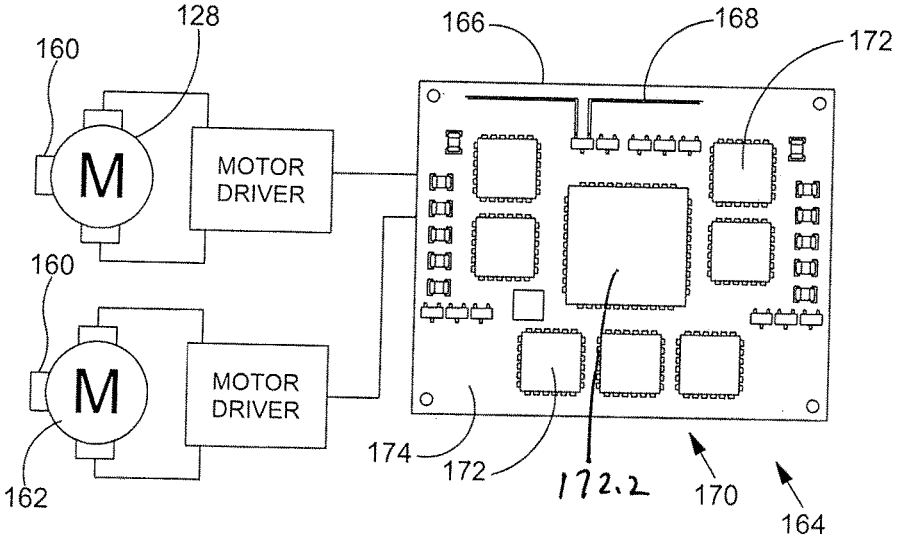
FIG. 18 is a stylized schematic showing the circuit board.

With reference to FIGS. 3A, 17-18, it will be appreciated that the magazine loader 100 includes a printed wiring board 166 supporting the circuitry 164. In the embodiment of FIG. 16, the printed wiring board 166 comprises a substrate supporting conductive paths 168, a plurality of electronic components 172, including processors 172.2, all of the circuitry 164.

Referring to FIGS. 3A, 13-18 and 21-22, in embodiments, the pusher mechanism 110 of the magazine loader 100 further includes a pusher detector 188 for detecting the presence of a pusher 136 in a home position of the pusher 136. In embodiments, the pusher detector 188 is operatively coupled to control circuitry 164, the control circuitry 164 comprising one or more processors and a non-transitory computer readable medium storing one or more instruction sets, the one or more instruction sets including instructions configured to be executed by the one or more processors to cause the control circuitry 164 to determine that the pusher 136 is present in the home position based on signals from the pusher detector 188.

Referring to FIGS. 2C and 15-17, in embodiments, the pusher mechanism 110 of the magazine loader 100 may further includes a cartridge detector 183 for detecting the presence of a cartridge 102 in a cartridge receiving area, which is the lowermost cartridge position 124.6. In embodiments, the cartridge detector 183 is operatively coupled to control circuitry 164, the control circuitry 164 comprising one or more processors and a non-transitory computer readable medium storing one or more instruction sets, the one or more instruction sets including instructions configured to be executed by the one or more processors to cause the control circuitry 164 to determine that the a cartridge is present in the cartridge receiving area based on signals from the cartridge detector 183. The lack of a cartridge may preclude operation of the pusher mechanism 110.

Figure 19:
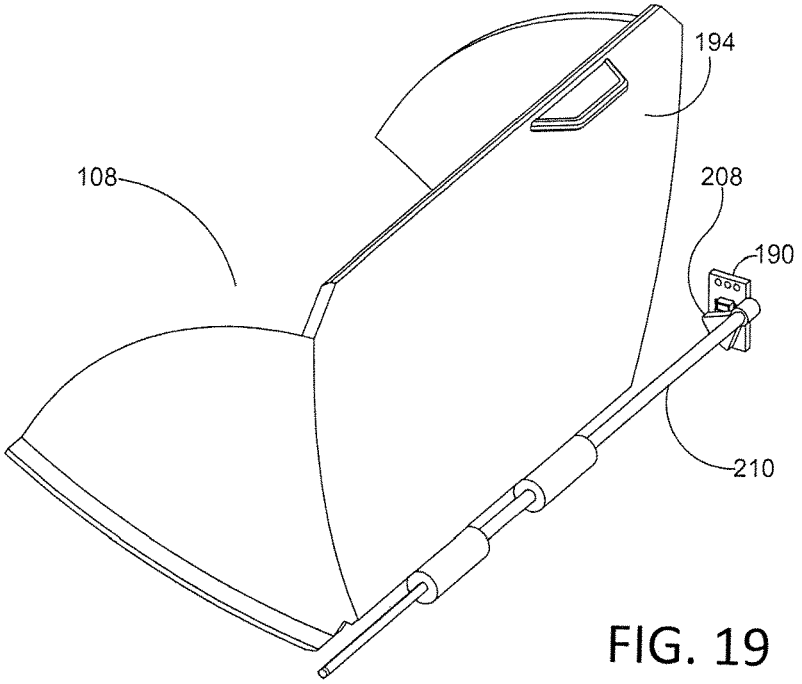
FIG. 19 is a perspective view showing a door and a door position detector.
Figure 20:
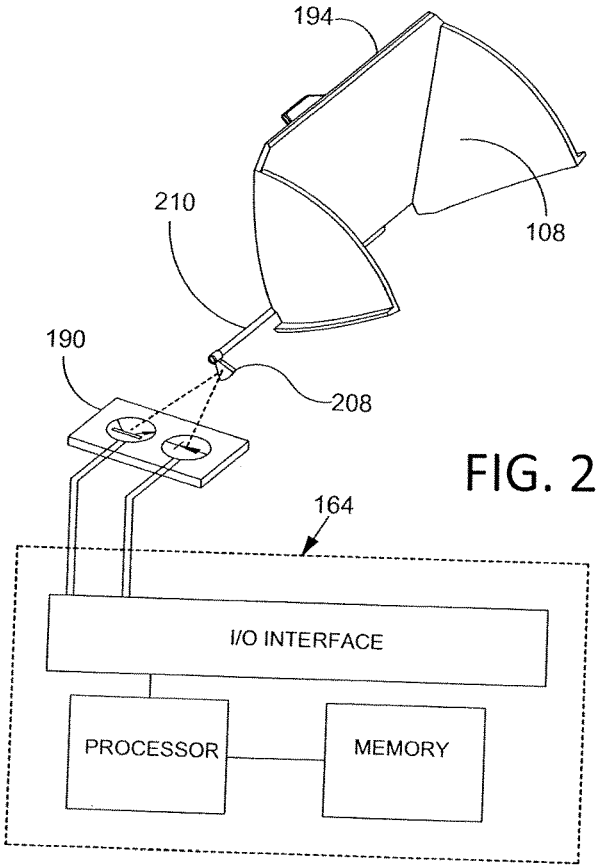
FIG. 20 is a perspective view depicting a door detector being operatively coupled to control circuitry.
Figure 21:
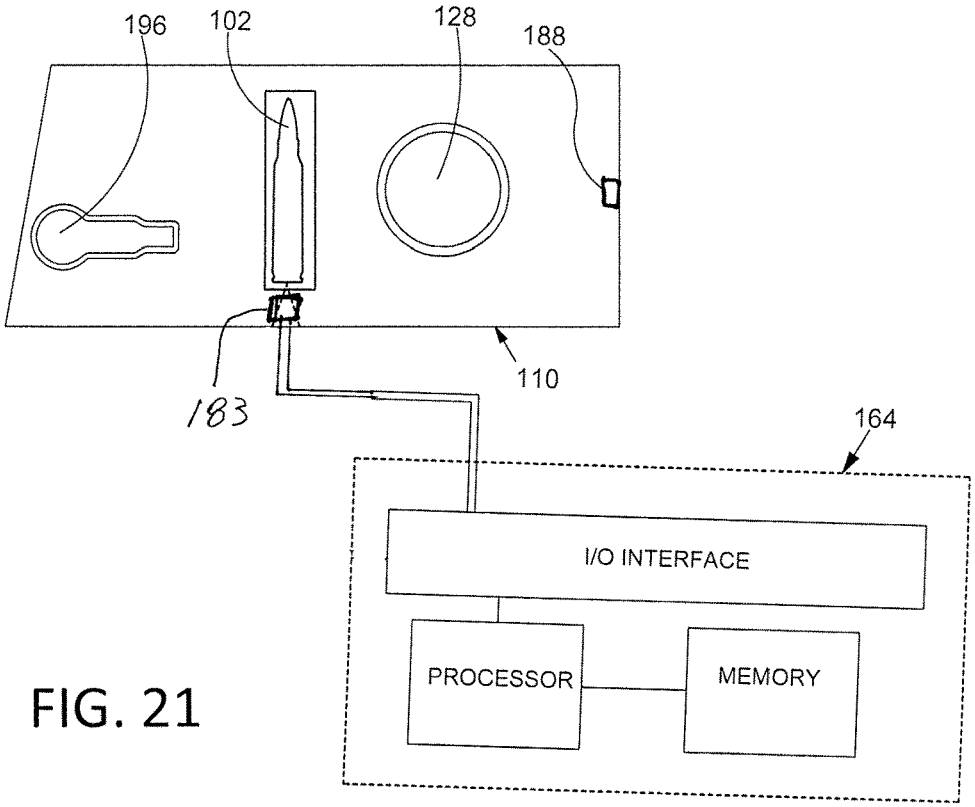
FIG. 21 is a stylized schematic showing a pusher mechanism for a magazine loader and a cartridge detector, the cartridge detector being operatively coupled to control circuitry.
Figure 22:
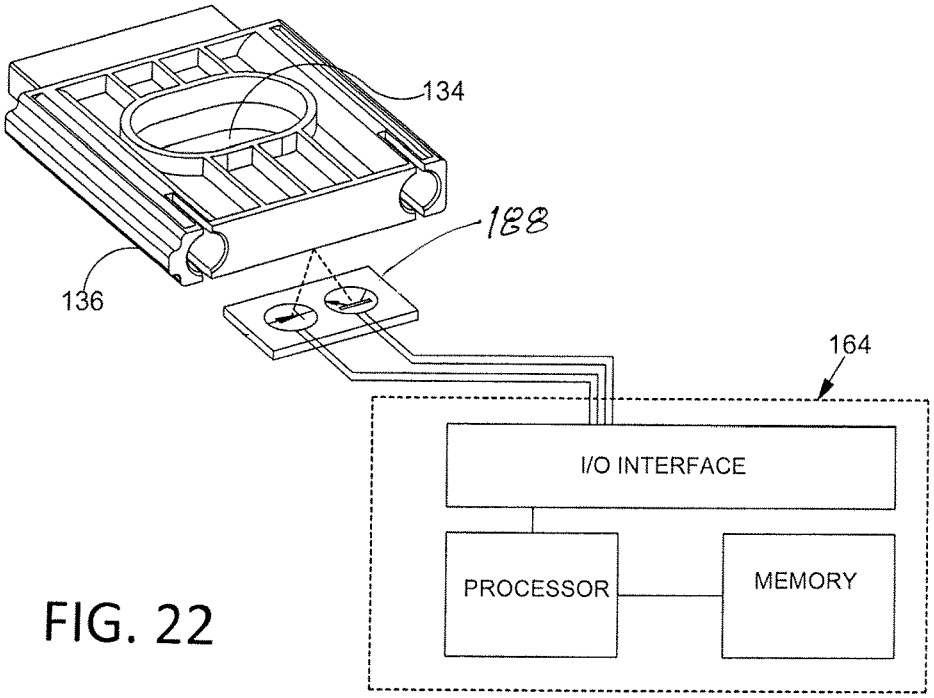
FIG. 22 is a plan view showing a pusher mechanism for a magazine loader, the pusher including a cartridge detector and a pusher detector for detecting whether a pusher of the pusher mechanism is in a home position.
Figure 23:
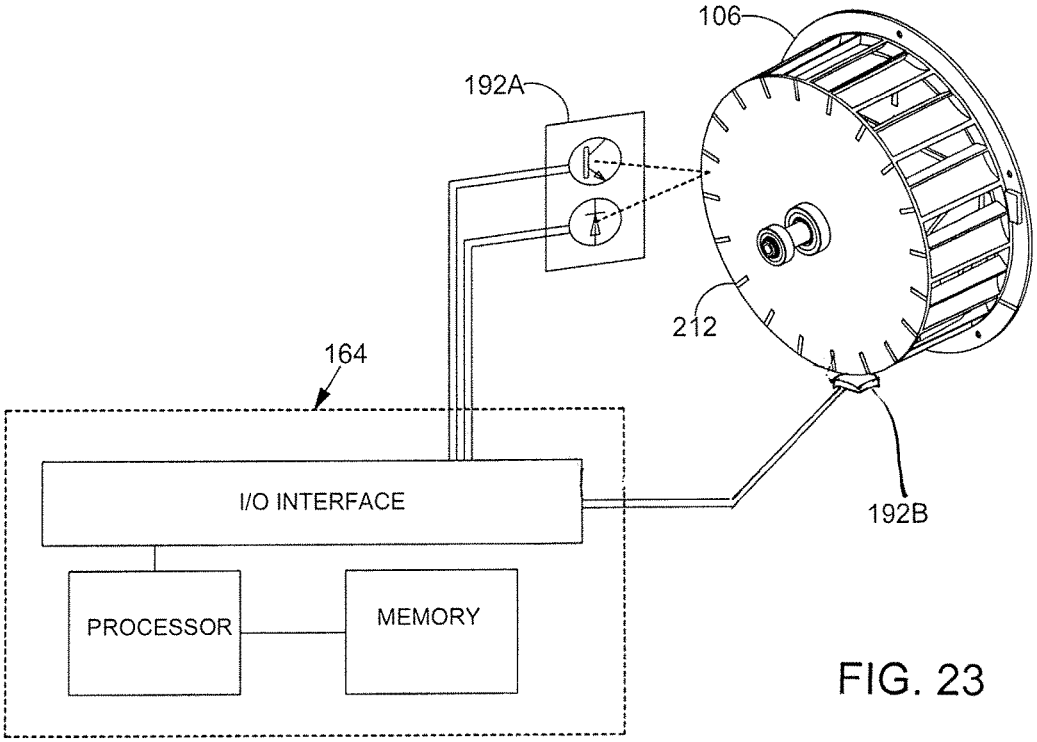
FIG. 23 is a perspective view showing a magazine loader assembly including a first wheel rotation detector and a second wheel rotation detector, each wheel rotation detector being operatively coupled to control circuitry.

Referring to FIGS. 17, 19-20, in embodiments, the magazine loader 100 includes a door detector 190 useful for determining whether or not the door 194 is in a closed position. In embodiments, the door detector 190 is operatively coupled to control circuitry 164, the control circuitry 164 comprising one or more processors and a non-transitory computer readable medium storing one or more instruction sets, the one or more instruction sets including instructions configured to be executed by the one or more processors to cause the control circuitry 164 to determine whether or not the door 194 is in a closed position based on signals from the door detector 190.

Referring to FIGS. 3A and 15-23, in embodiments, the pusher mechanism 110 of the magazine loader 100 further includes a magazine holding body 182 defining a magazine receiving cavity 184 and a magazine detector 186 for detecting the presence of a magazine 104 in the magazine receiving cavity 184. In embodiments, the magazine detector 186 is supported by the magazine holding body 182. In embodiments, the magazine detector 186 comprises optical sensors with a light source 156 and a light sensor 158. In embodiments, the light source 156 comprises a light emitting diode (LED) and the light sensor 158 comprises a phototransistor. In embodiments, the light source 156 emits a light emission and the light source is positioned such that the light emitting by the light source 156 travels into the magazine receiving cavity 184. In embodiments, the light sensor 158 provides a signal responsive to light reflected off of the magazine 104 when the magazine 104 is present in the magazine receiving cavity 184.

Referring to FIGS. 3A and 19-20, the magazine loader 100 may also include a door detector 190 for detecting the presence of a door 194 in a closed position of the door 194. In embodiments, the door detector 190 is supported by the housing 105 of the magazine loader 100. In embodiments, the door detector 190 comprises a light source 156 and a light sensor 158. In embodiments, the light source 156 comprises a light emitting diode (LED) and the light sensor 158 comprises a phototransistor. In embodiments, the light source 156 emits a light emission and the light source is positioned such that the light emitting by the light source 156 illuminates a portion of the door 194. In embodiments, the light sensor 158 provides a signal responsive to light reflected off of the door 194 when the door 194 is in its closed position. In embodiments, the magazine loader 100 also includes a wheel home detector 192 for detecting the presence of the wheel 106 in a home position of the wheel 106. In embodiments, the wheel home detector 192 is supported by the housing 105 of the magazine loader 100. In embodiments, the wheel home detector 192 comprises a light source 156 and a light sensor 158. In embodiments, the light source 156 comprises a light emitting diode (LED) and the light sensor 158 comprises a phototransistor. In embodiments, the light source 156 emits a light emission and the light source is positioned such that the light emitting by the light source 156 illuminates a portion of the wheel 106. In embodiments, the light sensor 158 provides a signal responsive to light reflected off of the wheel 106 when the wheel 106 is in its home position.

The following United States patents are hereby incorporated by reference herein: U.S. Pat. Nos. 4,464,855, 4,689,909, 4,719,715, 4,827,651, 4,829,693, 4,888,902, 4,993,180, 5,249,386, 5,355,606, 5,377,436, 6,810,616, 6,178,683, 6,817,134, 7,059,077, 7,257,919, 7,383,657, 7,487,613, 7,503,138, 7,637,048, 7,805,874, 9,212,859, 9,239,198, 9,347,722 and 9,273,917.

Referring to FIGS. 3A and 15-23, the circuitry 164 may comprise various elements without deviating from the spirit and scope of the present invention. For example, the circuitry may comprise combinational logic, a plurality of state loaders and a clock that provides a clock signal to the combinational logic and the plurality of state loaders. Each state loader may comprise state logic circuitry and a state memory. The state memory may comprise a plurality of memory elements such as flip-flops. The state logic circuitry of the state loader determines the conditions for changing the logical values of bits stored in the state memory. More particularly, the state logic circuitry of the state loader logically combines the binary values of a plurality of inputs with the binary values in the state memory representing the current state to generate a binary number representing the next state. The combinational logic circuitry may comprise various elements without deviating from the spirit and scope of the present description. For example, the combinational logic circuitry may comprise a plurality of discrete electronic components. By way of a second example, combinational logic circuitry may comprise a plurality of electronic components in the form of an application specific integrated circuit (ASIC). Examples of electronic components that may be suitable in some applications include logic gates. Examples of logic gates include, AND gates, NAND gates, OR gates, XOR gates, NOR gates, NOT gates, and the like. These logic gates may comprise a plurality of transistors (e.g., transistor-transistor logic (TTL)).

Still referring to FIGS. 3A and 17-18, the circuitry 164 may comprise various control elements without deviating from the spirit and scope of the present invention. In embodiments, for example, the circuitry 164 may comprise a processor, a memory, an input/output interface, a display, and a bus that communicatively couples the processor to the memory, the display and the input/output interface. In an embodiment, the processor may comprise a collection of one or more logical cores or units for receiving and executing instructions or programs. For example, in embodiments, the processor may be configured to receive and execute various routines, programs, objects, components, logic, data structures, and so on to perform particular tasks. In an embodiment, the memory is a collection of various computer-readable media in the system architecture. In various embodiments, memory can include, but is not limited to volatile media, non-volatile media, removable media, and non-removable media. For example, in embodiments, the memory can include random access memory (RAM), cache memory, read only memory (ROM), flash memory, solid state memory, or other suitable type of memory. In embodiments, the memory includes media that is accessible to the electronic circuitry 164. For example, in some embodiments, the memory includes computer readable media located locally in the circuitry 164 and/or media located remotely to the circuitry 164 and accessible via a network. In some embodiments, the memory includes a program product having a group of one or more logical instructions that are executable by the processor to carry out the functions of the various embodiments of the disclosure. In an embodiment, the bus comprises one or more of any of suitable type of bus structures for communicatively connecting the electronic elements. In various embodiments the bus may include a memory bus or memory controller, a peripheral bus, and a processor or local bus using any of a variety of bus architectures. In some embodiments, the circuitry 164 includes an I/O interface coupled to a processor. The I/O interface may facilitate communication between the various components and the circuitry 164. For example, in embodiments, the I/O interface may be communicatively coupled with one or more sensors. In certain embodiments the I/O interface facilitates communication with input and output devices for interacting with a user. For example, the I/O interface may communicate with one or more devices such, as a user-input device and/or a visual display 180, which enable a user to interact directly with the circuitry 164. The user-input device may comprise a keyboard 176, one or more push buttons 178, a touch screen, or other devices that allows a user to input information. The visual display 180 may comprise any of a variety of visual displays, such as a viewable screen, a set of viewable symbols or numbers, and so on.

The above references in all sections of this application are herein incorporated by references in their entirety for all purposes. Components illustrated in such patents may be utilized with embodiments herein. Incorporation by reference is discussed, for example, in MPEP section 2163.07(B).

"Substantially" when referring to a quality means mostly, unless otherwise defined, when referring to a quantified parameter, unless otherwise defined, means within 10% of that quantified parameter. "Substantially horizontal" means plus or minus 20° from horizontal. "Substantially" and "generally" include the exact quality or quantity described.

All of the features disclosed in this specification (including the references incorporated by reference, including any accompanying claims, abstract and drawings), and/or all of the steps of any method or process so disclosed, may be combined in any combination, except combinations where at least some of such features and/or steps are mutually exclusive.

Each feature disclosed in this specification (including references incorporated by reference, any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any incorporated by reference references, any accompanying claims, abstract and drawings), or to any novel one, or any novel combination, of the steps of any method or process so disclosed The above references in all sections of this application are herein incorporated by references in their entirety for all purposes.

Although specific examples have been illustrated and described herein, it will be appreciated by those of ordinary skill in the art that any arrangement calculated to achieve the same purpose could be substituted for the specific examples shown. This application is intended to cover adaptations or variations of the present subject matter. Therefore, it is intended that the invention be defined by the attached claims and their legal equivalents, as well as the following illustrative aspects. The above described aspects embodiments of the invention are merely descriptive of its principles and are not to be considered limiting. Further modifications of the invention herein disclosed will occur to those skilled in the respective arts and all such modifications are deemed to be within the scope of the invention.

What is claimed is:

1. An electronic magazine loader for loading cartridges into a magazine, the cartridges each having a forward projectile end and a rearward casing end with the forward projectile end being diametrically less than the rearward casing end, the loader comprising:

a housing including a housing enclosure defining a housing interior, the housing openable at a hopper portion, the hopper portion including a hopper cover hinged to a lower hopper portion, wherein when the hopper cover is open the hopper portion defines a hopper cavity extending to a cartridge receiving region in the housing interior;

a motorized sorting and lifting wheel assembly contained within the housing interior, the wheel assembly comprising a wheel rotatable about a horizontal axis and a drive motor for rotating the wheel, the wheel having an wheel open interior, the sorting and lifting wheel assembly being contained within the housing, the wheel having a periphery with a plurality of lifting shelves about the periphery for lifting individual cartridges from a batch of disordered cartridges received in the open interior of the wheel, the wheel having a plurality of peripheral windows, each peripheral window positioned adjacent one of the plurality of lifting shelves, the cartridge receiving region including a lower region of the wheel open interior;

a cylindrical wall portion in the housing interior, the cylindrical wall portion extending around the periphery of the wheel in a conforming arrangement with the wheel, the cylindrical wall portion having an opening positioned at a lateral side of the cylindrical wall portion, the opening defining a wheel discharge slot, whereby when a lifting shelf with a cartridge thereon is lifted to the opening, the cartridge is discharged through the opening;

a chute positioned at the discharge slot, the chute defining a passageway, the passageway extending downwardly at an upper portion of the chute, the chute having restrictive portions projecting into lateral ends of the passageway at the upper portion of the chute, the restrictive portions sized to allow passage of the forward projectile end of each cartridge but not the rearward casing end, whereby when a horizontally oriented cartridge enters the upper portion of the chute, as the cartridge falls downwardly the cartridge is re-oriented with the forward projectile end of the cartridge downward from the rearward casing end, the chute configured to narrow the passageway below the upper portion at a mid-portion of the chute, and the chute is further configured at the mid-portion of the chute to turn the narrowed passageway laterally, whereby when a cartridge enters the mid portion of the passageway as the cartridge travels down the passageway the cartridge moves laterally and is re-oriented toward a horizontal orientation, the chute further configured to have a lower portion that provides an upright stop surface to stop any lateral movement of the cartridge and a vertical accumulator portion for vertically stacking horizontally oriented cartridges, a lowermost cartridge position located at a lower end of the accumulator portion; and a loading portion positioned in the housing enclosure below the chute, the loading portion comprising a motorized cartridge pusher mechanism and magazine receiver with the lowermost cartridge position intermediate the motorized cartridge pusher mechanism and magazine receiver, whereby when a magazine is received in the magazine receiver and a cartridge is in the lowermost cartridge position of the accumulator portion, operation of the pusher mechanism loads the cartridge into the magazine.

2. The electronic magazine loader of claim 1, wherein the wheel is positioned adjacent to a sidewall portion of the housing enclosure and the hopper portion is on the sidewall portion where the wheel is positioned.

3. The electronic magazine loader of claim 2, wherein the lower hopper portion projects outwardly from the sidewall portion of the housing enclosure and wherein the lower hopper portion partially defines the cartridge receiving region, the lower hopper portion inclined toward a lowermost portion of the wheel.

4. The electronic magazine loader of claim 1, wherein the chute is formed at least in part by a polygonal shaped sidewall panel, the housing enclosure having a polygonal shaped recess on a side of the loader, the polygonal shaped sidewall panel conformingly shaped for insertion into the polygonal shaped recess.

5. The electronic magazine loader of claim 4, wherein the polygonal shaped recess in on a front side of the loader and the magazine receiver projects from the front side of the loader.

6. The electronic magazine loader of claim 1, wherein the chute is outwardly exposed on the front of the loader and an exterior wall portion of the chute is transparent.

7. The electronic magazine loader of claim 6, wherein the magazine receiver is positioned at on the front of the loader and wherein a user interface is positioned on the front of the loader above the sorting and lifting wheel.

8. The electronic magazine loader of claim 1, wherein the housing is formed from a polymer and the cylindrical wall portion is unitary with at least one sidewall portion of the housing enclosure.

9. The electronic magazine loader of claim 8, wherein the housing enclosure portion has four sides and four polymer sidewall portions with a respective sidewall portion at each side, and wherein at least two of the sidewall portions are unitary with one another and also unitary with the cylindrical wall portion and a wall plate portion traversing the cylindrical wall portion.

10. The electronic magazine loader of claim 1, wherein the total volume of the housing is less than 0.70 cu. ft., the total weight is less than 10 lbs. and the total height is less than 17 inches.

11. The electronic magazine loader of claim 1, further comprising control circuitry for operating and monitoring the operation of the loader, the control circuitry including jam mediation means.

12. An electronic magazine loader for loading cartridges into a magazine, the loader comprising:

a polymer housing including exterior wall portions defining an interior, the exterior wall portions having an inward upward tapering, the housing with a hopper openable in an outward direction from a side wall of the housing, the hopper defining a hopper cavity for receiving an unordered batch of cartridges, the hopper cavity opening into a cartridge receiving region;

a motorized wheel assembly contained and supported by the housing, the motorized wheel assembly comprising the wheel rotating about a substantially horizontal axis, the wheel defining a plurality of circumferentially spaced singularizing pockets for receiving and lifting cartridges serially in a continuous stream from the unordered batch of cartridges, the wheel being configured to singularize the cartridges of the batch while raising the cartridges serially to a wheel discharge slot, the wheel discharge slot open into a gravity fed chute defining a downwardly extending cartridge passageway so that cartridges that pass through the wheel discharge slot enter the passageway and travel downwardly;

a magazine loading portion contained by the housing, the magazine loading portion comprising a motorized pusher mechanism with a pusher that extends laterally into a magazine receiver, the cartridge passageway extending to a cartridge insertion position in the magazine loading portion;

a control circuitry portion with a user interface for controlling the motorized wheel and the motorized pusher mechanism;

wherein the housing has a volume of less than 0.90 cu. ft. and wherein the weight of the loader is less than 10 lbs. and wherein the footprint of the loader is less than 100 sq. in. and the height of the loader is less than 17 inches.

13. The electronic magazine loader of claim 12, where in the wheel is configured to lift the cartridges serially without forwardly/backwardly orienting the cartridges, and wherein the gravity fed chute comprises a forwardly/backwardly orienting portion.

14. The electronic magazine loader of claim 12, wherein the gravity fed chute is positioned at a front side of the loader and has an exterior transparent wall portion.

15. The electronic magazine loader of claim 12, wherein the gravity fed chute, the magazine receiver, and the user interface are all located on a front side of the loader.

16. The electronic magazine loader of claim 15 wherein the gravity fed chute is at least partially defined by a removable panel on the front side of the loader, and wherein the panel is formed of a transparent polymer.

17. The electronic magazine loader of claim 12 wherein the chute is comprised at least partially by a removable panel defining a passageway the passageway being shaped such that each cartridge falls tip first, by force of gravity, until the tip contacts a tip engaging and orienting surface of the removable panel, and each cartridge rotates to engage the tip engaging and orienting surface to orient/rotate each cartridge tip in the same direction, the cartridges sliding down the tip engaging and orienting surface into an accumulator portion to form a stack of oriented cartridges in the accumulator portion, a lowermost cartridge positon at the bottom of the accumulator portion, the lowermost cartridge position open laterally in two directions.

18. The electronic magazine loader of claim 12 wherein the pusher mechanism comprising a pusher positioned below the chute and a pusher motor, the pusher motor having a drive shaft and a cam member fixed to the drive shaft, the cam member being received in a cam following cavity of a pusher, the cam member being shaped so that the pusher oscillates in a first direction away from the magazine and a second direction toward the magazine as the cam member rotates in the cam following cavity, the pusher traveling between a home position and a cartridge seating position.

19. An electronic magazine loader for loading cartridges into a magazine suitable for desktop or benchtop use, the magazine loader having a top, a bottom, and four sides, the magazine loader comprising:

a polymer housing including a plurality of exterior wall portions defining an interior, the plurality of exterior wall portions having an upward and inward tapering such that the cross sectional interior area taken in horizontal planes decreases from the bottom of the loader toward the top of the loader;

a cartridge singularizing portion comprising a motorized wheel assembly mounted to the housing and positioned in the upper portion of the interior defined by the housing, the motorized wheel assembly comprising a wheel and a motor connected by a drive train to the wheel, the wheel having a rotational axis that is substantially horizontal and comprising a hub portion connected to the drive train, and a plurality of lifting shelves supported by the hub portion and positioned at an outer periphery of the wheel;

a cartridge loading portion comprising a hopper positioned laterally of the motorized wheel assembly;

a magazine loading portion in the interior and secured to the housing at or substantially at the bottom of the loader, the magazine loader comprising a magazine receiver with a receiving mouth exteriorly accessible, and a motorized pusher assembly with a pusher that extends into the magazine; and a gravity fed cartridge transfer portion extending from the singularizing portion to the magazine loading portion;

wherein, the total volume of the housing and interior is less than 0.90 cu. ft., the total weight is less than 12 lbs., the total footprint overall is less than 125 sq. in. and the total height is less than 17 inches.

20. The electronic magazine loader of claim 19, further comprising control circuitry for operating the loader, the control circuitry including a user interface positioned on a user interface panel.

* * * * *